United States Patent [19]

Motomura et al.

[11] 3,951,575

[45] Apr. 20, 1976

[54] CONTROLLED OUTPUT GEAR PUMP AND MOTOR

[75] Inventors: Mitsuteru Motomura, Kamakura; Masayuki Futamata, Kitamine; Yasuo Kitta, Yokohama, all of Japan

[73] Assignee: Kabushiki Kaisha Komatsu Seisakusho, Tokyo, Japan

[22] Filed: July 10, 1973

[21] Appl. No.: 377,922

[30] Foreign Application Priority Data

July 10, 1972 Japan ..... 47-68218

[52] U.S. Cl. ..... 417/283; 417/286; 418/126; 418/127; 418/196

[51] Int. Cl.[2] ..... F04B 49/02; F01C 19/04; F01C 1/08; F03C 3/00

[58] Field of Search .... 418/125–129, 131, 133, 196; 417/283, 286, 310; 91/59

[56] References Cited

UNITED STATES PATENTS

| | | | |
|---|---|---|---|
| 3,068,795 | 12/1962 | Lauck | 417/283 |
| 3,427,985 | 2/1969 | Difford | 418/126 |
| 3,472,170 | 10/1969 | Eckerle | 418/126 |
| 3,597,131 | 8/1971 | Schofield | 418/126 |

*Primary Examiner*—John J. Vrablik
*Attorney, Agent, or Firm*—Oblon, Fisher, Spivak, McClelland & Maier

[57] ABSTRACT

A gear pump and motor having a plurality of pumps and motors, each of which have at least three gears interengaged with one another, seal members disposed adjacent to the gears, and control means for selectively controlling the movement of the seal members toward or away from the gears of the pump and motors so as to selectively actuate the pumps and motors so as to attain a desired output.

2 Claims, 19 Drawing Figures

IX
S1
S2
S3
203
204
205
206
207
208
209
210
211
212
213
214
215
216
217
232
233
234
235
236
237
237'
238
239
240
241
242
242a
242b
242c
242d
243
244
245
246
246a
246b
247
248
249a
249b
250a
250b
251
252
253
254
255
256
257
258
T1
T2
P1
B1
H1
R1
K1
Q1
F1
R2
P2
K2
H2
B2
F2
Q2
K3
B3
H3
R3
F3
P3

416
403
415
418
405'
405
405a
405b
A
405c
405d
403
406
408
407b
407a
407
404
D1
E1
T1'
B
E2
T2'
En-1
U1 T1
W1
S1
V1
403
U2 T2
V2
W2
S2
Tn-1
Tn-1
Un-1
Vn-1
Sn-1
N
Wn-1
Dn
Y1
D2
Y2
D3
Y3
Yn-1
Bn
B1
B2
B3
P1
P2
P3
Pn
M
C1
C2
C3
Cn
422
402
403

416
403
415
418
404
405'
405
405a
405b
405c
405d
406
408
407b
407a
407
A
403
E1
E2
En-1
T1
T1'
B
T2
T2'
Tn-1
T'n-1
U1
U2
Un-1
V1
V2
Vn-1
W1
W2
Wn-1
S1
S2
Sn-1
N
D1
D2
D3
Dn
Y1
Y2
Y3
Yn-1
B1
B2
B3
Bn
P1
P2
P3
Pn
C1
C2
C3
Cn
422
M
402
403

CONTROLLED OUTPUT GEAR PUMP AND MOTOR

BACKGROUND OF THE INVENTION

1. Field of the Invention:

The present invention relates generally to a gear pump and motor, and more particularly to an improved gear pump and motor adapted for efficient operation at low speeds and having means for controlling the position of a sealing member relative to the gears within the pump and motor.

2. Description of the Prior Art:

Conventional gear pumps and motors are generally of the pressure balance type which tend to improve the pump and motor efficiency by actuating the seal member to a position adjacent to the engaging area of the meshed gears by utilizing the discharge or supply pressure so as to prevent internal oil leakage from the sealing chamber formed by means of the gears and the seal member. The seal member utilized within the conventional gear pumps and motors is thus urged to perform the sealing function in response to the discharge or supply pressure of the oil, and consequently is always actuated in the biased direction. A common occurrence experienced with various construction and industrial machinery employing such gear pumps and motors of the pressure balance type is the reduction in the pumping efficiency and improper responsiveness of the hydraulic components during low speed operation of the drive source and seizure and wear of the seal and rotary members during high speed operation.

Furthermore, when the gear pump and motor is in the idle condition, wherein work is not provided, or the volume discharge of oil which is supplied is more than the required amount, as the pump hydraulic circuit always maintains a hydraulic resistance of approximately 10–15kg/cm$^2$, such operation results in the consumption of some required power, and yet the discharged hydraulic oil is merely circulating throughout the pump and oil tank. Such operation, however merely consumes power and further increases the temperature of the oil with the result that such is not desirable for either the pump or the conduits and actuators within the hydraulic circuit for the increase in the oil temperature reduces the viscosity of the oil, and accordingly, such results in the decrease of the sealing effect of the seal members whereupon an increase in the internal oil leakage will occur which in turn causes oil leakage within the circuit conduits and actuators. In order to prevent such disadvantages, it is usually necessary to enlarge the conduits and valves so as to reduce the fluid resistance, however, in order to enlarge the valves and conduits, it sometimes becomes difficult to mount the same upon a vehicle, and in addition, it usually is not economical to do so.

The conventional gear pumps and motors have been generally used heretofore for transmission pumps, brake pumps, steering pumps, actuator pumps, or the like, but with respect to the operation of transmission pumps, brake pumps, and steering pumps, such pumps are required to perform their functions even during the idling operation of the engine which is used as a drive source of the pump. However, as the volume efficiency of the pumps of this type is generally reduced when the rotational speed is decreased, and particularly when the oil temperature is high, the volume efficiency may become 50 percent or less, the idling speed of the engine of the construction machinery being approximately 500 – 600 r.p.m. Under such conditions, even simple operations are difficult to perform often or coordinate.

In order to counteract such disadvantages, the speed of the drive source must be increased, or a pump having a larger volume discharge must be preselected. However, such requirements can be inconvenient, and the power loss noted heretofore is not resolved. If a pump having a sufficient capacity for supplying enough oil even during low speed operation of the engine is adopted, it has been noted that excessive torque is produced, and excessive volume discharge must be released through means of a relief valve during high speed operation thereof which of course is not preferable.

SUMMARY OF THE INVENTION

Accordingly, it is an object of the present invention to provide an improved gear pump and motor which may efficiently control the hydraulic fluid volume discharge in response to the load.

Another object of the present invention is to provide an improved gear pump and motor which has a plurality of pumps and motors capable of being selectively driven or stopped in response to the load.

Still another object of the present invention is to provide an improved gear pump and motor which may prevent a substantial temperature increase of the hydraulic fluid and which may restrict the power loss of the prime mover for the gear pump and motor by controlling the discharge pressure and volume of the fluid, the rotational speed of the pump and motor, and the external force applied thereto.

Yet another object of the present invention is to provide an improved gear pump and motor which may sufficiently compensate for the conventional reduction in volume efficiency during low speed operation of the drive source for the pump and motor, and the wear of the seal member and other pump components due to long periods of usage during high speed operation.

A further object of the present invention is to provide an improved gear pump and motor in which the degree of sealing between the gears and the seal member may be selected at an optimum value so as to prevent the wear and seizure of the seal member by the rotary components during high speed operation.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE PREFERRED EMBODIMENTS

In order to better understand the gear pump and motor of the present invention, the characteristics of a conventional gear pump and motor will first be described with particular reference to FIGS. 1 and 2, which are performance graphs respectively illustrating the relationship between the pump drive speed and the volume efficiency, and the relationship between the seal gap and the amount of fluid leakage.

Conventional gear pumps and motors are usually of the pressure balance type which have a seal member within the vicinity of the area in which the gears engage, and which is urged toward the gears by utilization of the discharge or supply pressure so as to prevent oil from leaking from the sealing chamber formed by means of the seal member and the gears. When such conventional gear pumps and motors are utilized particularly in conjunction with various construction machinery, the efficiency of such gear pumps and motors is reduced during low speed operation of the engine with the result that the response of the various hydraulic components and devices is also reduced. In addition, when the engine is operated at high speeds, the seal member readily becomes seized or worn by the rotary members.

Figure 1:
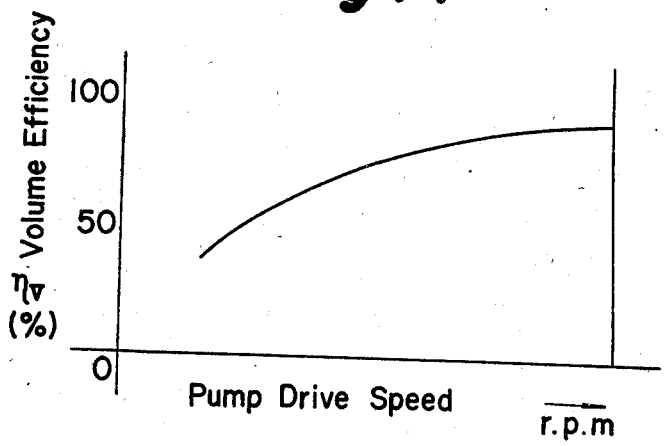
FIG. 1 is a graph showing the relationship between the volume efficiency and pump drive speed of a conventional gear pump and motor.

As noted heretofore, the conventional gear pumps and motors of the pressure balance type operate such that when the drive speed is decreased, the volume efficiency is also decreased as shown in FIG. 1, and when the temperature of the hydraulic oil increases, the volume efficiency is reduced still further with the result that the volume efficiency is sometimes reduced to a value approximately 50 percent. Construction machinery such as for example, tractors and bulldozers, ordinarily utilize idling engine speeds of approximately 500 – 600 r.p.m., and in order to compensate for the reduced responsiveness of the hydraulic components and devices, such as for example, the transmission pump, brake pump, steering pump, or working pump, during low speed operation of the engine, the idling speed of the engine is ordinarily raised or the output capacity of the hydraulic devices is ordinarily increased, but these techniques merely serve to increase the power loss.

Figure 2:
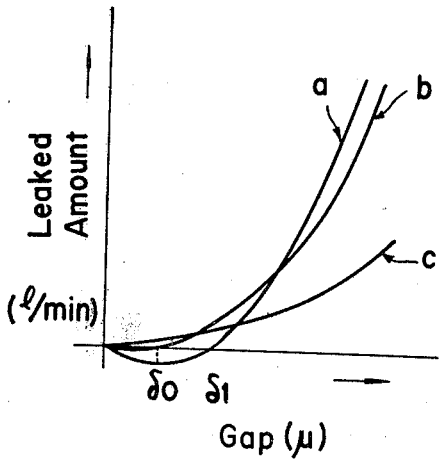
FIG. 2 is a graph showing the relationship between the fluid leakage and seal gap of a conventional gear pump and motor.

Furthermore, the amount of internal hydraulic leakage from the seal gap between the seal member and the gears is generally proportional to the cube of the gap, and has the tendency shown in FIG. 2 wherein curve a illustrates the amount of leakage from the gap between the end portions of the gear teeth and the seal block, curve b represents the amount of leakage from the gap between the side surfaces of the gears and the sides of the seal member, and curve c illustrates the amount of leakage from the gap between the seal block and the sides of the seal member.

The gear pump and motor of the present invention seeks to control the actuation of the seal member by means of the discharge pressure, the discharge flow rate, the rotational speed of the pump, or by an external force, so as to effectively control the pump discharge and pressure whereby the temperature of the hydraulic oil will be prevented from appreciably rising, and the volume efficiency will be substantially improved, and wear of the pump components will be reduced.

Figure 3:
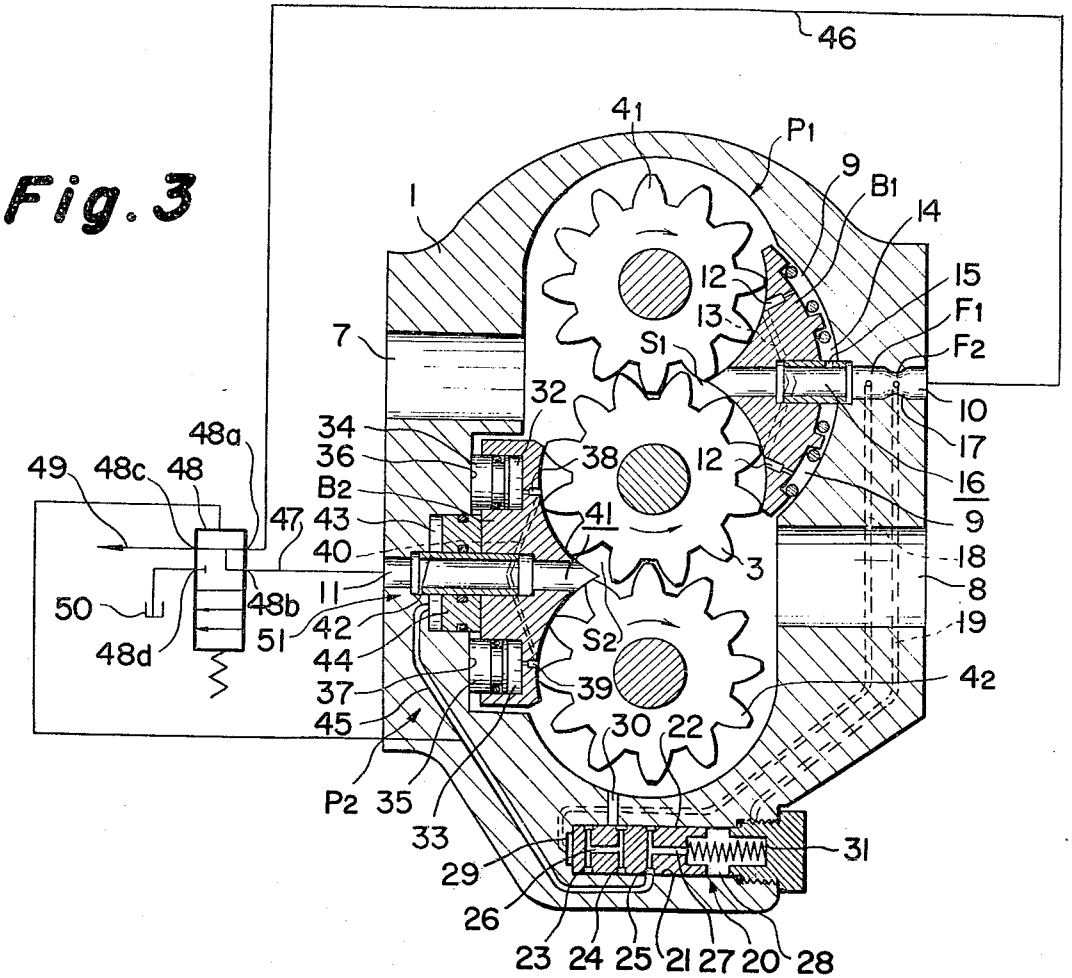
FIG. 3 is a schematic view, partly in section, of one embodiment of a gear pump and motor constructed according to the present invention and showing its cooperative parts.

Reference is now made to FIG. 3 in which there is shown a first embodiment of the gear pump and motor constructed according to the present invention as including a housing 1 in which a drive gear 3, driven by a prime mover, not shown, and driven gears 4 and 5 intermeshed with the drive gear 3, are respectively, rotatably supported. Laterally extending intake ports 7 and 8, and exhaust ports 10 and 11, are provided within the walls of the housing 1, and a seal block B1 is disposed within the vicinity of the engaging area S1 between the drive gear 3 and the driven gear 4 so as to form with housing 1 and gears 3 and 4, a first pump and motor, generally indicated by the reference character P1. A seal block B2 is likewise provided within the vicinity of the engaging area S2 between the drive gear 3 and the driven gear 5 so as to similarly form a pump and motor, generally indicated by the reference character P2.

The seal block B1 is of the self-holding type, and the side balance chambers 9 formed upon the outer surface of the seal block communicate through means of passages 12, with the spaces interposed between the teeth of the gears 3 and 4, as well as with each other through means of another passage 13. A central balance chamber 14, also formed upon the outer surface of the seal block B1 and interposed between chambers 9, communicates through means of a hole 15 with an exhaust hole 16 associated with exhaust port 10. A throttle 17 is formed within the exhaust port 10, and one end of passages 18 and 19 respectively open within the inlet area F1 and the constricted portion F2 of the port 10.

A control valve generally indicated by the reference character 20 is also provided within the housing 1 and includes a valve bore 21 within which a valve spool 22 is slidably disposed, a plurality of annular grooves 23, 24 and 25 being formed thereon in such a manner that the annular grooves 23 and 24 communicate with each other through means of a passage 26 while the annular groove 25 communicates with an oil chamber 28, formed within the rear portion of the valve spool 22, through means of a passage 27. At the forward end of the valve bore 21 there is similarly provided another oil chamber 29, and bore 21 is able to communicate through means of a passage 30, with the space between the teeth of the driven gear 5. The valve spool 22 is able to be urged forwardly or toward the left as seen in FIG. 3 by means of a spring 31 interposed between the valve spool 22 and the rear portion of the control valve 20, and in this state, the passage 30 is closed by means of the valve spool 22. The other end of the passage 18 communicates with the oil chamber 29, while the other end of the passage 19 communicates with the oil chamber 28.

A pair of balance chambers 32 and 33 are also formed upon the outer surface of seal block B2 and respectively include pistons 34 and 35 slidably disposed therein, the front faces of the pistons contacting wall portions 36 and 37 of housing 1. The balance chambers 32 and 33 respectively communicate with the spaces formed between the teeth of the gears 3 and 5 through means of apertures 38 and 39 which are respectively formed within the seal block B2, and are also able to communicate with each other through means of another passage 40 formed within the seal block B2.

A guide tube 42 is slidably and sealingly disposed within the larger diameter portion of an exhaust passage 41 which is provided within the seal block B2 so as to be located within the vicinity of the engaging portion S2 of the drive gear 3 and the driven gear 5, the front end of the guide tube 42 being similarly slidable within the exhaust port 11 of the housing 1. An oil chamber 43 is also formed within the housing 1 and is interposed between the exhaust port 11 and the seal block B2, a piston 44 being slidably disposed within the oil chamber 43 so as to form an actuating mechanism generally indicated by the reference character 51 for urging the seal block B2 toward the gears 3 and 5. Oil chamber 43 communicates with the valve bore 21 of the control valve 20 through means of a passage 45 also provided within the housing 1.

Associated with the aforementioned hydraulic circuitry is a control valve 48 which has ports **48*a* and 48*b* at one side thereof and ports 48*c* and 48*d* at the other side thereof, a spool 48' being provided whereby when spool 48' is within a first position the port 48*a* communicates with the ports 48*b* and 48*c* while the port 48*d* does not communicate with any of the other ports, and when the spool is within a second position, the ports 48*a* and 48*b* communicate with the ports 48*c* and 48*d*, respectively. A spring 48'' urges the spool 48' in a direction counter to the hydraulic pressure transmitted through means of a conduit 54 which connects the passage 45 with the other end of the spool 48'. It will also be noted that the exhaust ports 10 and 11 are connected through means of conduits 46 and 47 to the ports 48*a* and 48*b*, respectively, while the port 48*c* of the control valve 48 is connected through means of a conduit 49 to a hydraulic actuator, and the port 48*d* of the control valve 48 is connected through means of a drain conduit 50 with a fluid reservoir 50'**.

Within the gear pump and motor thus constructed, when the drive gear 3 is driven by means of the prime mover, not shown, the pump and motor P1 is accordingly operated so that hydraulic fluid discharged from the exhaust port 10 is supplied through means of the conduit 46 and the port **48*a*, and through the spool 48' and the port 48*c*, which communicates with the port 48*a* through means of the spool 48', to the hydraulic actuator. When the engine connected to the prime mover is within the idle state for starting procedures, the rotational speed of the pump and motor P1 is low, and consequently, the exhaust of the pump and motor P1 is also low. The pressure difference between the fluid flowing through the constricted portion F2 of the throttle 17 and the fluid flowing through the inlet area F1 of the exhaust port 10 is therefore also small, and accordingly, the pressure difference between the oil chambers 28 and 29 of the control valve 20 is likewise small with the result that the valve spool 22 is urged toward the left as seen in FIG. 3 by means of the spring 31**.

Consequently, hydraulic fluid is supplied from the exhaust port 10 of the pump and motor P1 through the passage 19, the oil chamber 28 which is in communication with the passage 19, aperture 27 which is formed within the valve spool 22 of the control valve 20 and is similarly in communication with the oil chamber 28, annular groove 25 formed upon the valve spool 22, and passage 45 which is in communication with groove 25 at one end and the oil chamber 43 at the other end so as to urge the piston 44 and the seal block B2 toward the engaging area S2 between the drive gear 3 and the driven gear 5. In this manner, the pump and motor P2 formed by the drive gear 3, driven gear 5 and the seal block B2 begins to operate whereby the hydraulic fluid received via the intake port 8 is discharged from the exhaust port 11 through means of the conduit 47 which communicates with the exhaust port 11, port **48*b* of the control valve 48 which communicates with the conduit 47, the valve spool 48', the port 48*c* of the control valve 48, and the conduit 49** to the hydraulic actuator, not shown.

When the rotational speed of the engine, and accordingly the prime mover becomes high, the speed of the pump and motor P1 also becomes high whereby the discharge of the pump and motor P1 is accordingly increased. The hydraulic fluid flow rate through the exhaust port 10 thus becomes faster and consequently, the difference in flow rates between the fluid flowing through the constricted portion F2 of the throttle 17 and the fluid flowing through the inlet area F1 of the exhaust port 10 is increased with the result that the fluid pressure difference therebetween is increased.

Figure 4:
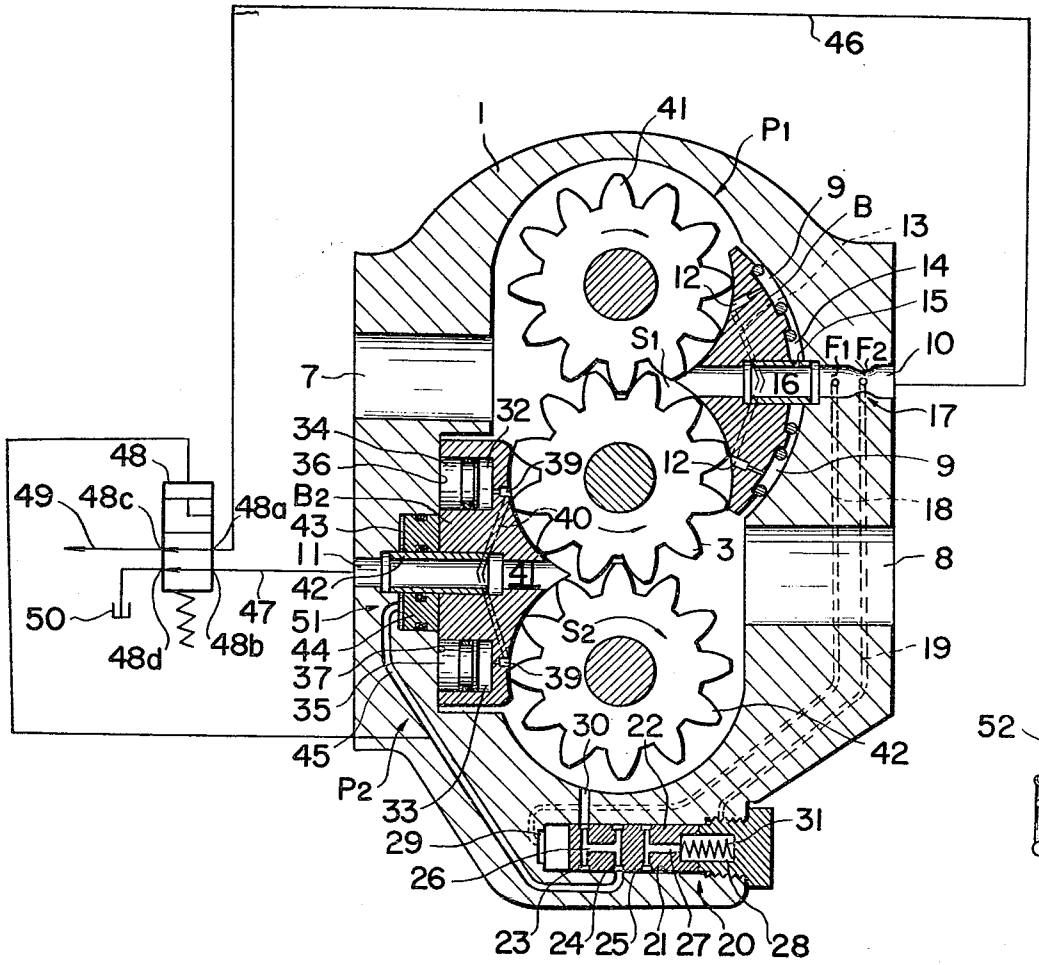
FIG. 4 is a view similar to that of FIG. 3, showing however the gear pump and motor under high speed operative conditions.

Therefore, the hydraulic pressure within the oil chamber 29 of the control valve 20 becomes larger than that of the oil chamber 28 of the control valve 20 so that the valve spool 22 is urged toward the right as seen in FIG. 4 against the force of the spring 31 with the result that the passage 45 is placed in communication with the annular groove 24 which communicates through means of passageway 26 with the annular groove 23 which in turn is in communication with the passage 30 which is hydraulically connected with the area between the teeth of the driven gear 5. Accordingly, the hydraulic fluid within the oil chamber 43 may be introduced into the passage 45, annular groove 24, annular groove 23, and passage 30 to the area formed between the teeth of the driven gear 5 whereby such fluid flow permits the force urging the seal block B2 into the engaging area S2 between the drive gear 3 and the driven gear 5 through means of the piston 44 to diminish.

Consequently, the pump and motor P2 ceases to operate, and only the pump and motor P1 continues to operate in order to discharge the hydraulic fluid through the conduit 46 and the control valve 48 into the actuator, not shown. In addition, when the hydraulic pressure applied to the actuator, not shown, becomes greater than a preset value such that the pressure difference between the fluid flowing through the constricted portion F2 of the throttle 17 and the fluid flowing through the inlet area F1 of the exhaust port 10 is increased, the spool 22 of the control valve 20 is urged toward the right as seen in FIG. 4 against the biasing force of the spring 31, with the result that hydraulic pressure within the passage 45 is decreased whereby the spring 48'' may shift the spool 48' of the control valve 48 and accordingly the hydraulic fluid from the exhaust port 11 of the pump and motor P2, which normally communicates, through means of the conduit 47 with the port **48*b* of the control valve 48 so as to be in communication with the conduit 49 and the actuator, not shown, may now be conducted to the fluid reservoir 50', as illustrated in FIG. 4**.

Figure 5:
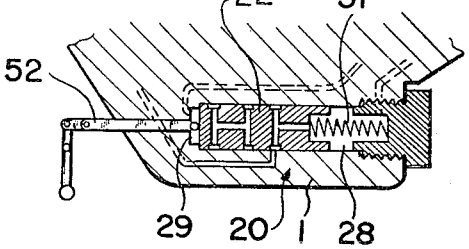
FIG. 5 is another embodiment of a control valve which may be utilized within the gear pump and motor shown in FIGS. 3 and 4.

Referring now to FIG. 5, there is shown another embodiment of the control valve 20 whereby manual control of the pump and motor P2 may be accomplished, the valve 20 comprising a manual lever 52 connected to the front end of the spool 22 whereby the spool may be manually urged toward the right as seen in FIG. 5 for permitting the abatement of the force urging the seal block B2 toward the area S2.

In considering the pumps and motors P1 and P2 as hydraulic motors, the hydraulic operation is diametrically opposite to that described heretofore, wherein the actuator, not shown, now becomes a pump, and the control valve 20 is automatically operated in accordance with the variation in the discharge pressure of the actuator as a pump, and thus, the pumps and motors P1 and P2 are operated so as to produce the output torque.

It should be understood from the foregoing description that since the gear pump and motor of the present invention comprises a housing 1, a first pump and motor means P1 having a drive gear 3 driven by a prime mover, not shown, and a driven gear 4 intermeshed with the drive gear 3 and rotatably mounted within the housing 1, and a seal block B1 disposed within the vicinity of the engaging area S1 of the drive gear 3 and the driven gear 4 and including the various hydraulic components associated therewith as noted heretofore, a second pump and motor means P2 which includes the drive gear 3 and a driven gear 5 also intermeshed with the drive gear 3 and rotatably mounted within the housing 1, and a seal block B2 disposed within the vicinity of the engaging area S2 of the drive gear 3 and the driven gear 5 and similarly including the various hydraulic components associated therewith as noted heretofore, and control valve means 20 hydraulically interposed between the seal blocks B1 and B2, when the rotational speed of the pump and motor means P1 is low whereby the volume discharged therefrom is also low, the spring 31 disposed within the control valve 20 urges the spool 22 toward the oil chamber 29 so as to conduct the exhaust fluid from the exhaust port 10, through the control valve 20 and the passage 45, and into the oil chamber 43 for urging the seal block B2, through means of the piston 44, toward the gears 3 and 5, so as to actuate the pump and motor means P2, while when the drive gear 3 is driven at a higher rate of speed so as to achieve a large volume discharge from the exhaust port 10, the discharged fluid from the exhaust port 10 is transmitted to the oil chamber 29 of the control valve 20 so as to urge the valve spool 22 against the biasing force of the spring 31 whereby the oil chamber 43 of the pump and motor means P2, through means of the passage 45 and the control valve 20, is in communication with the space between the teeth of the driven gear 5 so as to discharge the hydraulic fluid within the oil chamber 43 therethrough and into such space whereupon the pumping action of the pump and motor means P2 ceases in order to conserve the consumed fluid, and consequently an efficient gear pump and motor has been provided.

Figure 6:
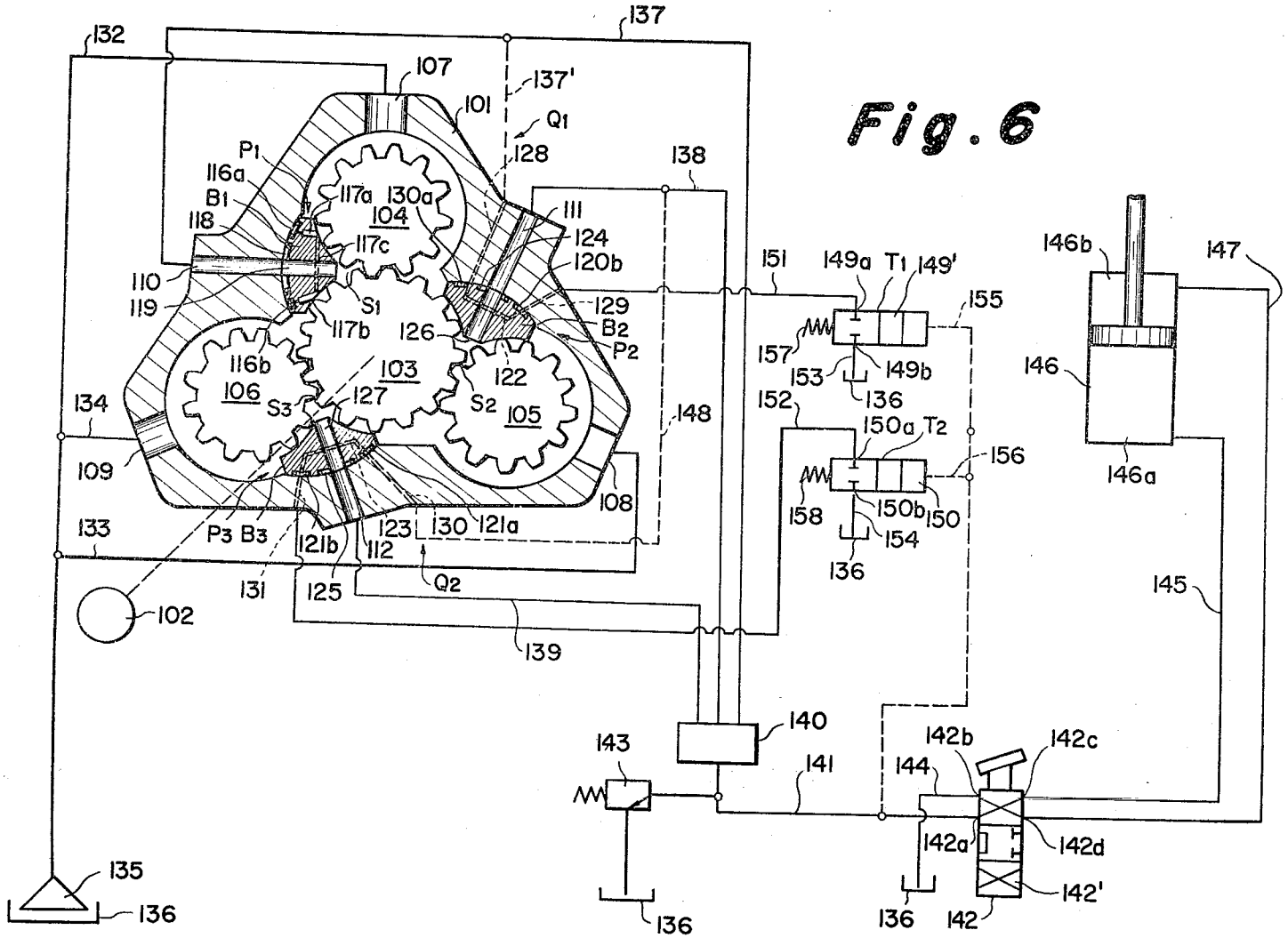
FIG. 6 is a view similar to that of FIG. 3 showing however another embodiment of a gear pump and motor constructed according to the present invention and showing it cooperative parts.

Referring now to FIG. 6, which discloses a second embodiment of a gear pump and motor constructed according to the present invention, a substantially triangular shaped housing 101 has a drive gear 103, driven by means of a prime mover 102, and driven gears 104, 105 and 106 respectively intermeshed with the drive gear 103, rotatably supported therein, gears 104–106 being equidistantly disposed about the periphery of gear 103. Intake ports 107, 108 and 109 and exhaust ports 110, 111 and 112 are provided within the housing 101, and a seal block B1 is provided within the vicinity of the engaging area S1 between the drive gear 103 and the driven gear 104 so as to form a first pump and motor generally indicated by the reference character P1. A seal block B2 is similarly provided within the vicinity of the engaging area S2 between the drive gear 103 and the driven gear 105 so as to form a second pump and motor, generally indicated by the reference character P2, and a seal block B3 is also provided within the vicinity of the engaging area S3 between the drive gear 103 and the driven gear 106 so as to form a third pump and motor, generally indicated by the reference character P3.

The seal block B1 is of the self-holding type, and side balance chambers **116*a* and 116*b* formed upon the outer surface of the seal block B1 communicate, through means of passages 117*a* and 117*b*, with the areas formed between the teeth of the driven and drive gears 104 and 103, respectively, and may also communicate with each other through means of another passageway 117*c*. A central balance chamber 118 also formed upon the outer surface of the seal block B1 and interposed between chambers 116a and 116b annularly surrounds and communicates with an exhaust passage 119 formed within the seal block B1, while side balance chambers 120***a* and 120*b* formed upon the outer surface of the seal block B2 communicate with each other through means of a passageway 122 and a central balance chamber 124 interposed between chambers 120*a* and 120*b* and also formed upon the outer surface of the seal block B2 annularly surrounds and communicates with an exhaust passage 126 formed within the seal block B2. Side balance chambers 121*a* and 121*b* formed upon the outer surface of the seal block B3 likewise communicate with each other through means of a passage 123 and a central balance chamber 125 also formed upon the outer surface of the seal block B3 and interposed between chambers 121*a* and 121*b* annularly surrounds and communicates with an exhaust passage 127 formed within the seal block B3.

Passages 128 and 129 formed within the housing 101 respectively permit communication between the side balance chambers 120a and 120b, and the area exterior of the housing 101, and passages 130 and 131 also formed with the housing 101 likewise permit communication between the side balance chambers 121a and 121b and the area exterior of the housing 101, respectively. The intake ports 107, 108 and 109 of the pumps and motors P1, P2 and P3, respectively, communicate through means of conduits 132, 133 and 134, respectively, with a common conduit associated with a strainer 135 and a fluid reservoir or tank 136, and the exhaust ports 110, 111 and 112 are respectively connected through means of conduits 137, 138, and 139 to a manifold valve 140 which is connected through means of a conduit 141 to a control valve 142 and to a relief valve 143.

Control valve 142 is manually operable and includes ports 142*a* and 142*b* at one side thereof, and ports 142*c* and 142*d* at the other side thereof, a spool 142' being disposed within the valve 142 such that when the spool is at a first position, port 142*a* is in communication with the port 142*c* and the port 142*b* is in communication with the port 142*d*, while when the spool is at a second position, port 142*a* is in communication with the port 142*b* and the ports 142*c* and 142 do not communicate with any other port, and when the spool is located at still a third position, the ports are in communication similar to that associated with the first position.

Furthermore, the port 142*a* is in communication with the manifold valve 140 through means of the conduit 141, port 142*b* is in communicaion with the fluid reservoir 136 through means of a drain conduit 144, port 142*c* is connected to an actuator 146, such as for example, a cylinder, at the bottom portion 146*a* thereof, through means of a conduit 145, and port 142*d* is connected, through means of a conduit 147, to the upper portion 146*b* of the actuator 146. Conduit 137 is also in communication with the passage 128 formed within the housing 101 and associated with the second pump and motor P2 through means of a pilot conduit 137' and the conduit 138 is similarly in communication with the passage 130 formed within the housing 101 and assoicated with the third pump and motor P3 through means of another pilot conduit 148.

The hydraulic circuitry further includes control valves T1 and T2 which have ports 149*a* and 149*b*, and 150*a* and 150*b*, respectively, and spools 149' and 150', respectively. The spool 149' of the control valve T1 has a first position wherein the ports 149*a* and 149*b* do not communicate with any other port, and a second position wherein port 149*a* is in communication with the port 149*b*. The conrol valve has assoicated therewith a spring 157 so disposed as to urge the spool 149' against the hydraulic pressure supplied from the exhaust ports of the pumps and motors P1, P2, and P3 through means of a conduit 155 which connects the control valve T1 with the conduit 141 so as to be accordingly connected to both port 142*a* of control valve 142 and to the manifold valve 140. The spool 150' of the control valve T2 also has a first position wherein the ports 150*a* and 150*b* do not communicate with any other port, and a second position wherein port 150*a* is in communication with the port 150*b*. The control valve T2 also has associated therewith a spring 158 so disposed as to urge the spool 150' against the hydraulic pressure supplied from the exhaust ports of the pumps and motors P1, P2 and P3 through means of a conduit 156 which is also connected to the conduit 141 so as to be in communication with both port 142*a* of control valve 142 and manifold valve 140.

The port 149*a* of the control valve T1 is also in communication with the passage 129 formed within the housing 101 and associated with the pump and motor P2 through means of pilot conduit 151 so as to form a pilot circuit, generally indicated by the reference character Q1, and the port 149*b* is in communication with the fluid reservoir 136 through means of a drain conduit 153. The port 150*a* of the conrol valve T1 is likewise in communication with the passage 130 formed within the housing 101 and associated with the pump and motor P3 through means of another pilot conduit 152 so as to form a second pilot circuit, generally indicated by the reference character Q2, and the port 150*b* is in communication with the fluid reservoir 136 through means of a drain conduit 154.

Within the gear pump and motor thus constructed according to this embodiment, when the drive gear 103 is driven by means of the prime mover 102, the driven gear 104 of the pump and motor P1 is driven by means of the drive gear 103 whereby the fluid reservoir or tank 136 is drawn through the conduit 132 and into the intake port 107 and is accordingly discharged from the exhaust port 110 through means of the conduit 137 connected thereto, manifold valve 140, conduit 141, port 142*a* of control valve 142, and conduit 145 and into the bottom portion 146*a* of the actuator 146.

In this state, if the hydraulic fluid pressure thus supplied to the actuator 146 is too low so as not to be able to actuate the actuator 146, hydraulic fluid is fed from the conduit 137 through the pilot conduit 137' and the passage 128 within the pilot circuit Q1 and into the balance chambers 120*a* and 120*b* associated with the second seal block B2 with the result that the seal block B2 is biased toward the drive gear 103 and the driven gear 105 so that the second pump and motor P2 commences to operate, and accordingly the hydraulic fluid thus discharged from the exhaust port 111 is fed through means of the conduit 138, manifold valve 140, conduit 141, and conduit 145 and into the bottom portion 146*a* of the actuator 146.

If the hydraulic fluid pressure thus supplied to the actuator 146 is still insufficient to actuate the actuator 146, hydraulic fluid is then fed from the conduit 138 through the pilot conduit 148 and the passage 130 within the pilot circuit Q2 and into the balance chambers 121*a* and 121*b* within the third seal block B3 with the result that the seal block B3 is urged toward the drive gear 103 and the driven gear 106 so that the third pump and motor P3 begins to operate and accordingly hydraulic fluid exhausted from the exhaust port 112 is conducted through the conduit 139, manifold valve 140, conduit 141, ports 142*a* and 142*c* of control valve 142, and conduit 145 into the bottom section 146*a* of the actuator 146.

Figure 7:
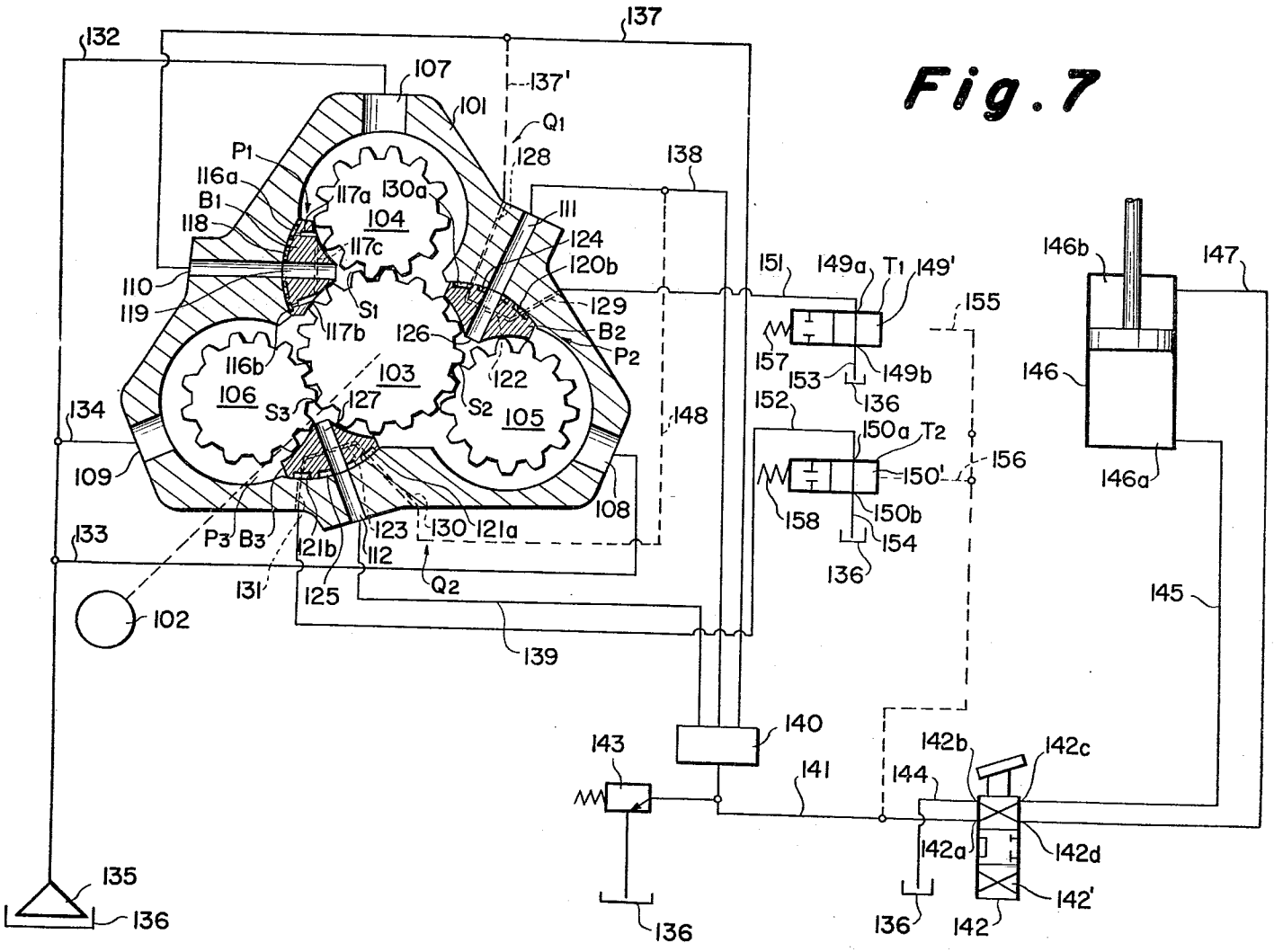
FIG. 7 is a view similar to that of FIG. 6, showing however the gear pump and motor under high speed operative conditions.

When the hydraulic fluid pressure thus supplied to the actuator 146 becomes greater than the inherent tensional force of the spring 158 associated with the control valve T2, the spool 150' of the control valve T2 is switched to the alternate position, as shown in FIG. 7, wherein the port 150*a* is now in communication with the port 150*b* within the control valve T2 with the result that the pilot conduit 152 is drained through the conrol valve T2 and the conduit 154 to the fluid reservoir 136 whereupon the balance chambers 121*a* and 121*b* of the seal block B3 are drained therethrough so as to release the pressure tending to urge the seal block B3 toward the drive gear 103 and the driven gear 106, the operation of the pump and motor P3 thereby terminating.

Continuing further, when the hydraulic fluid pressure supplied to the actuator 146 becomes greater than the inherent tensional force of the spring 157 associated with the control valve T1, the spool 149' of the control valve T1 will be similarly switched to the alternate position as is also shown in FIG. 7, whereby the port 149*a* will now be in communication with the port 149*b* with the result that the pilot conduit 151 will be drained through the control valve T1 and the conduit 153 to the fluid reservoir 136 whereupon the balance chambers 120*a* and 120*b* of the seal block B2 are drained therethrough so as to release the pressure tending to urge the seal block B2 toward the drive gear 103 and the driven gear 105, the operation of the pump and motor P2 thereby terminating.

In considering the pumps and motors P1, P2 and P3 as hydraulic motors, the hydraulic operation is entirely opposite to that described heretofore wherein the actuator 146 becomes a pump and the control valves T1 and T2 are automatically operated in accordance with the variation in the discharge pressure of the actuator whereupon the pumps and motors P1, P2 and P3 are operated so as to produce the various desired torques. It will be further apparent to those skilled in the art that although the particular embodiment of the gear pump and motor of his invention has been described as having one drive gear 103 and three driven gears 104, 105 and 106, three pumps and motors P1, P2 and P3 with three seal blocks B1, B2 and B3, and two control valves T1 and T2, the gear pump and motor of the present invention may comprise a plurality of driven gears, a plurality of pumps and motors P1, P2 . . . Pn with a plurality of seal blocks B1, B2, . . . Bn, and a plurality of control valves T1, T2, . . . T*n l*-1 in order to achieve the same objects and effects as noted heretofore.

Furthermore, it should also be appreciated from the foregoing description of this embodiment that since the gear pump and motor of this embodiment of the present invention comprises a housing 101, a first pump and motor means P1 which includes a drive gear 103 driven by a prime mover 102 and a driven gear 104 intermeshed with the drive gear 103 rotatably mounted within the housing 101, and a seal block B1 disposed within the vicinity of the engaging area S1 between the drive gear 103 and the driven gear 104, a second pump and motor means P2 which includes the drive gear 103 and a driven gear 105 also intermeshed therewith and rotatably mounted within the housing 101, and a seal block B2 disposed within the vicinity of the engaging area S2 between the drive gear 103 and the driven gear 105, a third pump and motor means P3 which also includes the drive gear 103 and a driven gear 106 intermeshed therewith and rotatably mounted within the housing 101, and a seal block B3 disposed within the vicinity of the engaging area S3 between the drive gear 103 and the driven gear 106, and a second control valve T2, if the hydraulic fluid pressure supplied to the actuator 146 from the gear pump and motor is insufficient to actuate the actuator 146, the seal block B2 is biased toward the drive gear 103 and the driven gear 105 through means of the pilot circuit Q1 associated with the pump and motor P2 so as to commence operation of the second pump and motor P2 in order to supply additional hydraulic fluid to the motor 146, and if the hydraulic fluid thus supplied to the actuator 146 is still insufficient, the seal block B3 will in turn be urged toward the drive gear 103 and the driven gear 106 through means of the pilot circuit Q2 associated with the pump and motor P3 so as to feed still additional hydraulic fluid to the actuator 146 in order to actuate the same to the desired speed.

Accordingly, if the number of pumps and motors is increased further whereby the pumps and motors within the system may be characterized as P1, P2, . . . P*n*, the amount of hydraulic fluid supplied to the actuator 146 may be multiplied by the factor n so as to achieve a working speed n times the speed of the system when merely employing a single pump and motor P1, and furthermore, when the hydraulic fluid pressure thus supplied to the actuator 146 tends to place the system in an overloaded condition, the seal blocks B3 and B2 are able to be released from the biased positions relative to the drive gear 103 and the driven gears 106 and 105 so as to reduce the hydraulic fluid supplied to the actuator 146 in response to the variation of the load impressed upon the actuator 146 in order to effectively and efficiently operate the same.

Figure 8:
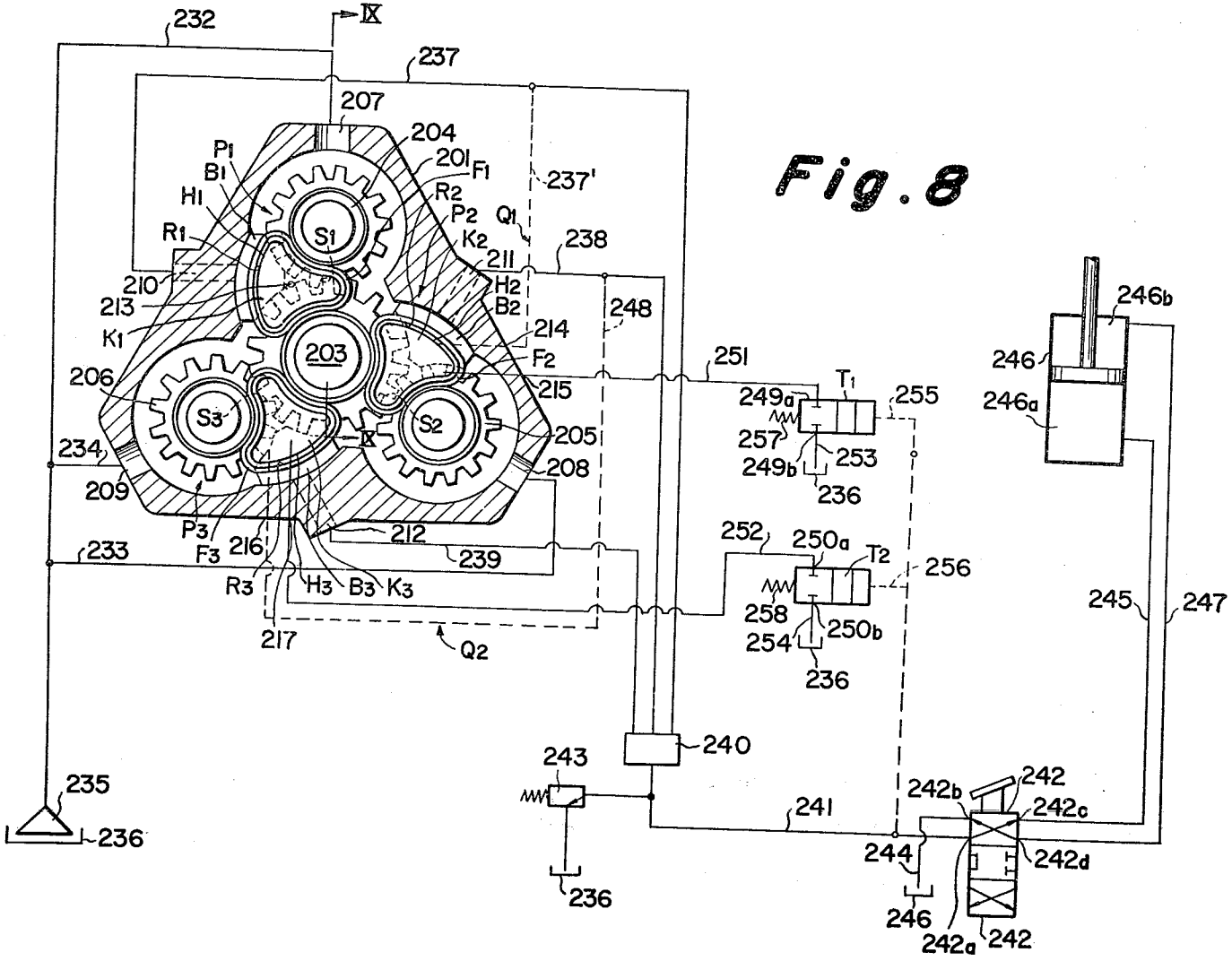
FIG. 8 is a view similar to that of FIG. 3 showing however still another embodiment of a gear pump and motor constructed according to the present invention and showing its cooperative parts.
Figure 9:
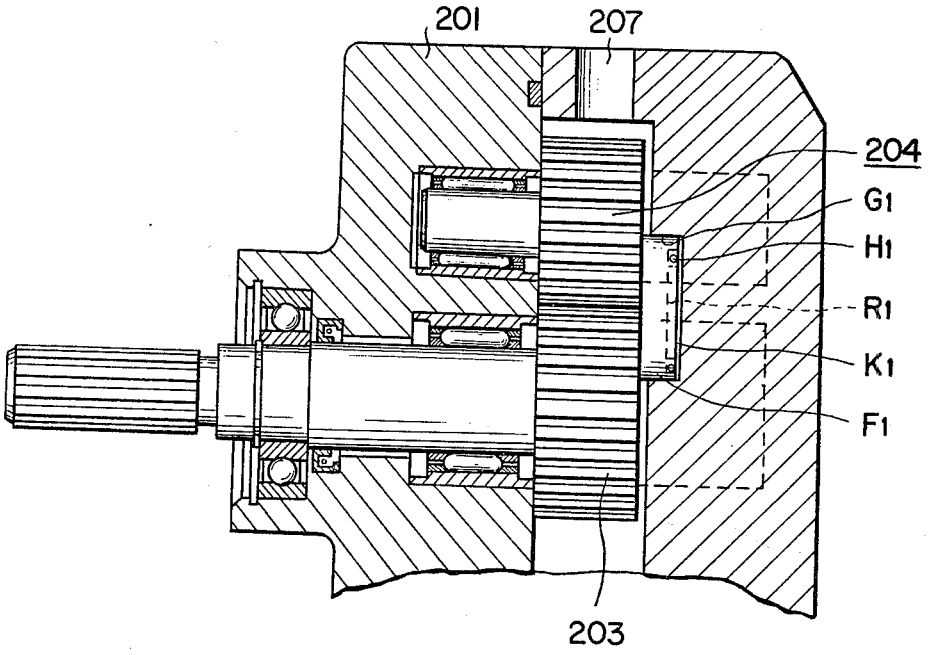
FIG. 9 is a partial, cross-sectional view of the gear pump and motor of FIG. 8 taken along the line IX-IX in FIG. 8.
Figure 10:
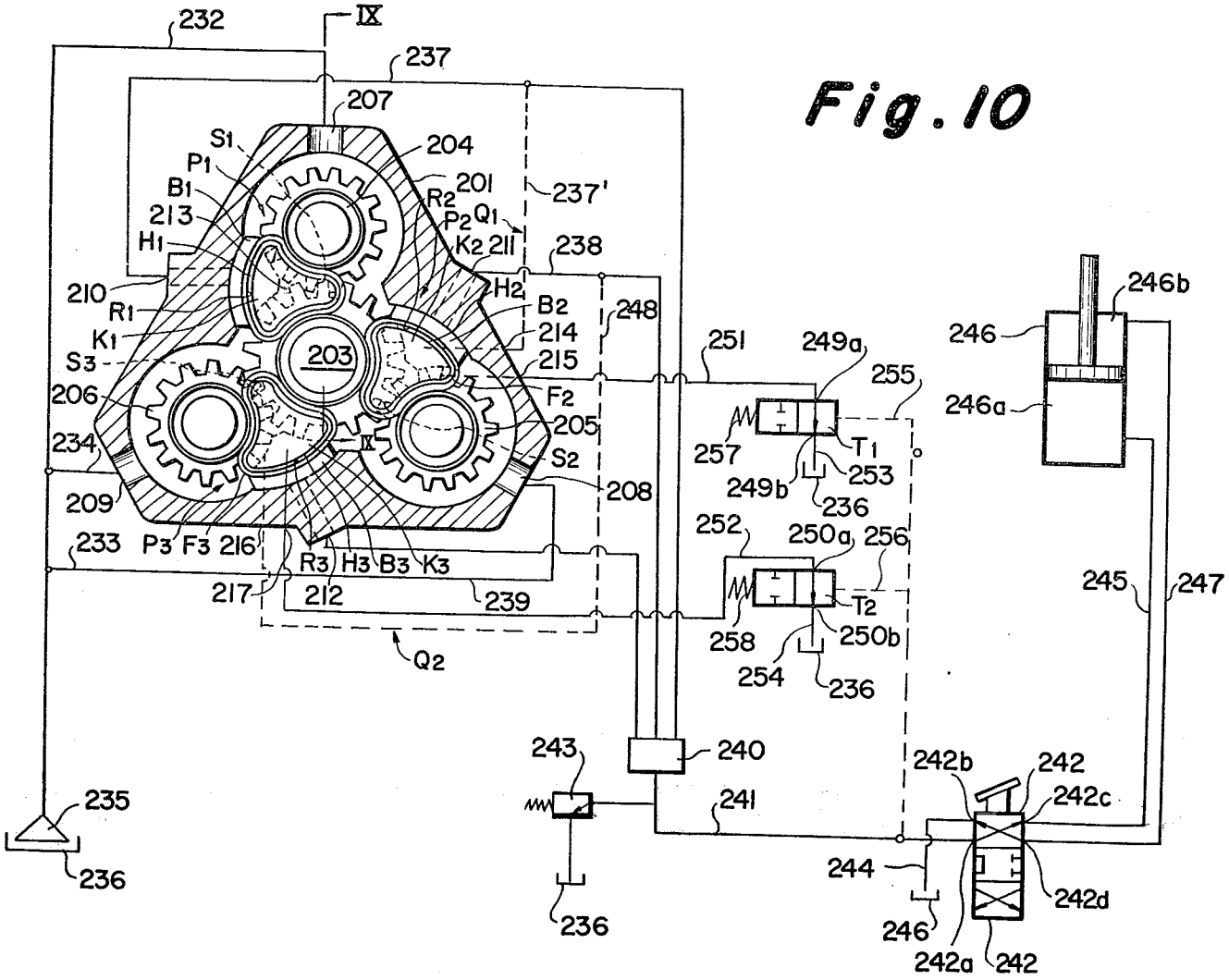
FIG. 10 is a view similar to that of FIG. 8, showing however the gear pump and motor under high speed operative conditions.

Referring now to FIGS. 8–10, a further embodiment of the gear pump and motor constructed according to the present invention is disclosed as including a substantially triangular housing 201 in which a drive gear 203, driven by means of a prime mover, not shown, and driven gears 204, 205 and 206 intermeshed with the drive gear 203, are respectively, rotatably supported in such manner that gears 204–206 are equidistantly disposed about the periphery of gear 203. Intake ports 207, 208 and 209 and exhaust ports 210, 211 and 212 are provided within the housing 201 in association with the gears 203, 204, 205 and 206, and a seal block B1 is also provided within the vicinity of the engaging area S1 between the drive gear 203 and the driven gear 204 so as to form a first pump and motor, generally indicated by the reference character P1. Another seal block B2 is likewise provided within the vicinity of the engaging area S2 between the drive gear 203 and the driven gear 205 so as to form a second pump and motor, generally indicated by the reference character P2, while still another seal block B2 is provided within the vicinity of the engaging area S3 between the drive gear 203 and the driven gear 206 so as to form a third pump and motor, generally indicated by the reference character P3.

In addition, seal side plates F1, F2 and F3 are respectively provided adjacent to the seal blocks B1, B2 and B3, of the pump and motors P1, P2 and P3, and as illustrated in detail in FIG. 9, are slidably and sealingly inserted into respective grooves G1, G2 and G3, which are formed upon the interior surface of the housing 201. Recesses R1, R2 and R3 are in turn respectively formed upon the outer surfaces of seal side plates F1, F2 and F3, and O-rings H1, H2 and H3 are respectively engaged within the recesses R1, R2 and R3 so as to be in contact with the surfaces of the grooves G1, G2 and G3 whereupon pressure chambers K1, K2 and K3 are respectively formed. In this manner, the effective areas of the seal side plates are large enough relative to the engaged areas S1, S2 and S3 between the drive and driven gears so as to completely cover the sealing arcuate portions of the drive and driven gears so as to in fact seal the engaging areas of the drive and driven gears in conjunction with the seal blocks.

The first seal side plate F1 is of the self-holding type, and the pressure chamber K1 communicates through the means of a passage 213 formed within the housing 201 with the engaging area S1 between the drive gear 203 and the driven gear 204, while passages 214 and 215 permit communication between the pressure chamber K2 associated with the second seal side plate F2 and various control components, and passages 216 and 217 likewise permit communication between the pressure chamber K3 associated with the seal side plate F3 and various control components as will be more apparent hereinafter.

The intake ports 207, 208 and 209 of the pumps and motors P1, P2 and P3 respectively communicate, through means of conduits 232, 233 and 234 and a strainer 235, with a fluid reservoir or tank 236, and the exhaust ports 210, 211 and 212 thereof are similarly respectively connected through means of conduits 237, 238 and 239 to a manifold valve 240 which is in turn connected through means of a conduit 241 to a control valve 242 as well as a relief valve 243.

Control valve 242 is manually operable and is provided with ports **242*a* and 242*b* at one side thereof and ports 242*c* and 242*d* at the other side thereof. A spool 242' is movably disposed within valve 242 such that when the spool is located at a first position, the port 242*a* is in communication with the port 242*c* while the port 242*b* is in communication with the port 242*d*, and when the spool is located at a second position, the port 242*a* is in communication with the port 242*b* while the ports 242*c* and 242*d* are not in communication with any other port, and when the spool is located within still a third position, the circuitry is similarly connected as when the spool was in the first position. Port 242*a* also communicates through means of the conduit 241 with the manifold valve 240, and port 242*b* communicates through means of a drain conduit 244 with the fluid reservoir 246, while port 242*c* is connected through means of a conduit 245 to the lower section 246*a* of an actuator 246, such as for example a cylinder, and the port 242*d* is connected through means of another conduit 247 which leads to the upper section 246*b* of the actuator 246. Conduit 237 associated with exhaust port 210 communicates through means of a pilot conduit 237' with the passage 214 formed within the housing 201 and associated with the second pump and motor P2, and the conduit 238 associated with port 211 communicates through means of a pilot conduit 248 with the passage 216 formed within the housing 201** and associated with the third pump and motor P3.

The gear and pump motor of this embodiment also includes control valves T1 and T2 which have ports **249*a* and 249*b*, and 250*a* and 250*b*, respectively, spools 249' and 250' being respectively movable therewithin. The spool 249' of the control valve T1 may be located at a first position wherein the ports 249*a* and 249*b* are not in communication with any other port or within a second position wherein the port 249*a* is in communication with the port 249*b*. The control valve T1 has a spring 257 so disposed at one end thereof as to tend to urge the spool 249' against the hydraulic pressure supplied thereto through means of a conduit 255 which is connected at the other end of the control valve T1 and which is connected to the port 242*a* of the control valve 242 as well as the conduit 241 which is fluidically connected to the manifold valve 240 so as to receive the fluid pressure from the pumps and motors P1, P2 and P3. The spool 250' is likewise movable between a first position wherein the ports 250*a* and 250*b* do not communicate with any other port and a second position wherein the port 250*a* is in communication with the port 250*b*. The control valve T2 also has a spring 258 so disposed at one end thereof as to tend to urge the spool 250' against the hydraulic pressure supplied thereto through means of a conduit 256 which is connected at the other end of the control valve T2 and which is also connected to the port 242*a* of the control valve 242 as well as the conduit 241 which is in turn connected to the manifold valve 240** so as to also receive the hydraulic pressure from the pumps and motors P1, P2 and P3.

Still referring to FIG. 8 and with particular reference to the hydraulic circuitry, port 249 of the control valve T1 is fluidically connected through means of a pilot conduit 251 with the passage 215 formed within the housing 201 and associated with the pump and motor P2 so as to form a pilot circuit generally indicated by the reference character Q1, and the port **249*b* thereof is fluidically connected through means of a drain conduit 253 with the fluid reservoir 236. The port 250*a* of the control valve T1 communicates through means of a pilot conduit 252 with the passage 217 formed within the housing 201 and associated with the pump and motor P3 so as to form a second pilot circuit, generally indicated by the reference character Q2, and the port 250*b* thereof communicates through means of a drain conduit 254 with the fluid reservoir 236**.

Within the gear pump and motor thus constructed as disclosed within this embodiment, when the drive gear 203 is driven by means of the prime mover, not shown, the driven gear 204 of the pump and motor P1 is driven by means of a drive gear 203 intermeshed therewith so that fluid within the fluid reservoir or tank 236 is drawn through the conduit 232, into the intake port 207, and is accordingly discharged from the exhaust port 210 through means of the conduit 237, manifold valve 240, conduit 241, control valve 242, and conduit 245 so as to be conducted into the lower section **246*a* of the actuator 246**.

Under such conditions, if the hydraulic fluid pressure thus supplied to the actuator 246 is not sufficient so as to in fact actuate the actuator 246 at the desired speed, hydraulic fluid is then fed from the conduit 237 through means of the pilot conduit 237' through the passage 214 within the pilot circuit Q1 which is in communication with the pressure chamber K2 of the second seal side plate F2 with the result that the seal side plate F2 is urged toward the side portions of the engaging area S2 between the drive gear 203 and the driven gear 205 whereby the second pump and motor p2 commences operation, and accordingly hydraulic fluid discharged from the exhaust port 211 is fed through the conduit 238, manifold valve 240, conduit 241, control valve 242, and conduit 245 so as to be conducted into the lower section 246*a* of the actuator 246.

If the hydraulic fluid thus supplied to the actuator 246 is still insufficient to actuate the actuator 246, hydraulic fluid is then also fed from the conduit 238 through means of the pilot conduit 248 and into the passage 216 within the pilot circuit Q2 which is in communication with the pressure chamber K3 of the third seal side plate F3 with the result that the seal side plate F3 is urged toward the side portions of the engaging area S3 between the drive gear 203 and the driven gear 206 whereby the third pump and motor P3 begins to operate, and accordingly hydraulic fluid discharged from the exhaust port 212 is fed through means of the conduit 239, manifold valve 240, conduit 241, control valve 242, and the conduit 245 so as to be conducted into the lower section 246*a* of the actuator 246.

When the hydraulic fluid pressure supplied to the actuator 246 becomes greater than the inherent tensional force of the spring 258 of the control valve T2, the spool 250' associated therewith is moved to the alternate position, as shown in FIG. 10, whereby port 250*a* is now in communication with the port 250*b* whereupon the pilot conduit 252 is drained through the control valve T2 and the conduit 254 to the fluid reservoir 236. Consequently, the pressure chamber K3 associated with the third seal side plate F3 may be drained therethrough so as to release the pressure exerted upon and biasing the seal side plate F3 toward the drive gear 203 and the driven gear 206, such sequence resulting in the termination of the pumping action of the pump and motor P3.

Continuing further, when the hydraulic fluid pressure supplied to the actuator 246 becomes greater than the inherent tensional force of the spring 257 associated with the control valve T1, the spool 249' disposed within the control valve T1 will be moved to the alternate position, as shown in FIG. 10, wherein the port 249*a* will be in communication with the port 249*b* with the result that the pilot conduit 251 will be able to be drained through the control valve T1 and the conduit 253 to the fluid reservoir 236. consequently, the pressure chamber K2 associated with the second seal side plate F2 may be drained therethrough so as to release the pressure exerted upon and biasing the seal side plate F2 toward the drive gear 203 and the driven gear 205, such fluidic operation resulting in the termination of the pumping action of the pump and motor P2.

In considering the pumps and motors P1, P2 and P3 as hydraulic motors, the hydraulic operation is of course opposite to that described heretofore, wherein the actuator 246 becomes a pump, and the control valves T1 and T2 are automatically operated in accordance with the variation in the discharge pressure supplied from the actuator which is serving as a pump, and thus the pumps and motors P1, P2 and P3 are operated so as to produce the various desired torques.

From the foregoing description, it will be apparent to those skilled in the art that although the aforedescribed embodiment of the gear pump and motor of this invention is disclosed as including one drive gear 203 and three driven gears 204, 205 and 206, three pumps and motors P1, P2 and P3 having associated therewith three seal blocks B1, B2 and B3, and three seal side plates F1, F2 and F3, and two control valves T1 and T2, the gear pump and motor of the present invention may also comprise a plurality of driven gears, a plurality of seal blocks B1, B2, . . . B*n* together with a plurality of seal side plates F1, F2, . . . F*n* and a plurality of control valves T1, T2, . . . T*n*-1 whereby objects and effects similar to those described heretofore may be achieved.

It should also be apparent from the foregoing analysis of this embodiment that since the gear pump and motor of this embodiment of the present invention comprises a housing 201, a first pump and motor means P1 which includes a drive gear 203 driven by means of a prime mover and a driven gear 204 intermeshed therewith and rotatably mounted within housing 201, a first seal block B1 disposed within the vicinity of the engaging area S1 between the drive gear 203 and the driven gear 204 and having associated therewith a seal side plate F1 which includes an O-ring H1 so as to form a first pressure chamber K1, a second pump and motor means P2 which includes the drive gear 203 and a driven gear 205 intermeshed therewith and rotatably mounted within the housing 201, a second seal block B2 disposed within the vicinity of the engaging area S2 between the drive gear 203 and the driven gear 205 and having associated therewith a seal side plate F2 which includes an O-ring H2 so as to form a second pressure chamber K2, a third pump and motor means P3 which also includes the drive gear 203 and a driven gear 206 intermeshed therewith and rotatably mounted within the housing 201, a third seal block B3 disposed within the vicinity of the engaging area S3 between the drive gear 203 and the driven gear 205 and having associated therewith a seal side plate F3 which includes an O-ring H3 so as to form a third pressure chamber K3, a first control valve T1, and a second control valve T2, if the hydraulic fluid supplied to the actuator 246 is insufficient to actuate the actuator 246, the seal side plate F2 is urged toward the drive gear 203 and the driven gear 205 through means of hydraulic fluid within the pilot circuit Q1 associated with the pump and motor P2 so as to actuate the second pump and motor P2 in order to feed additional hydraulic fluid to the actuator 246, and if the hydraulic fluid thus supplied to the actuator 246 is still insufficient, then the seal side plate F3 is urged toward the drive gear 203 and the driven gear 206 through means of hydraulic fluid within the pilot circuit Q2 associated with the pump and motor P3 in order to feed still more hydraulic fluid to the actuator 246.

Naturally, the number of pumps and motors within the system can be further increased so as to be characterized by the reference characters P1, P2, . . . P*n* whereby the amount of hydraulic fluid capable of being supplied to the actuator 246 may be multiplied by the factor *n* so as to attain a working speed *n* times that which would be obtained when utilizing a single pump and motor, and furthermore, when the hydraulic fluid pressure thus supplied to the actuator 246 tends to place the system in an overloaded condition, the seal side plates F3 and F2 are able to be released rom the biased positions relative to the drive gear 203 and the driven gears 206 and 205 so as to reduce the hydraulic fluid supplied to the actuator 246 in response to the variation of the load impressed upon the actuator 246 in order to efficiently operate the same.

Figure 11:
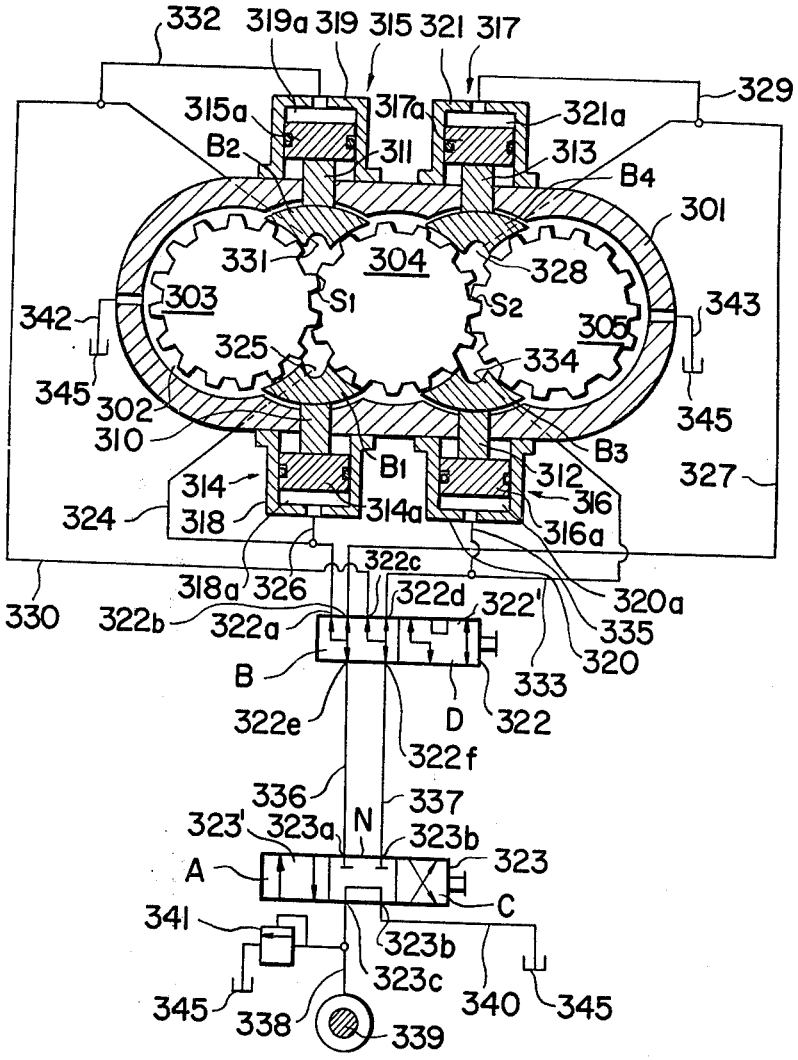
FIG. 11 is a view similar to that of FIG. 3 showing however yet another embodiment of a gear pump and motor constructed according to the present invention and showing its cooperative parts.
Figure 12:
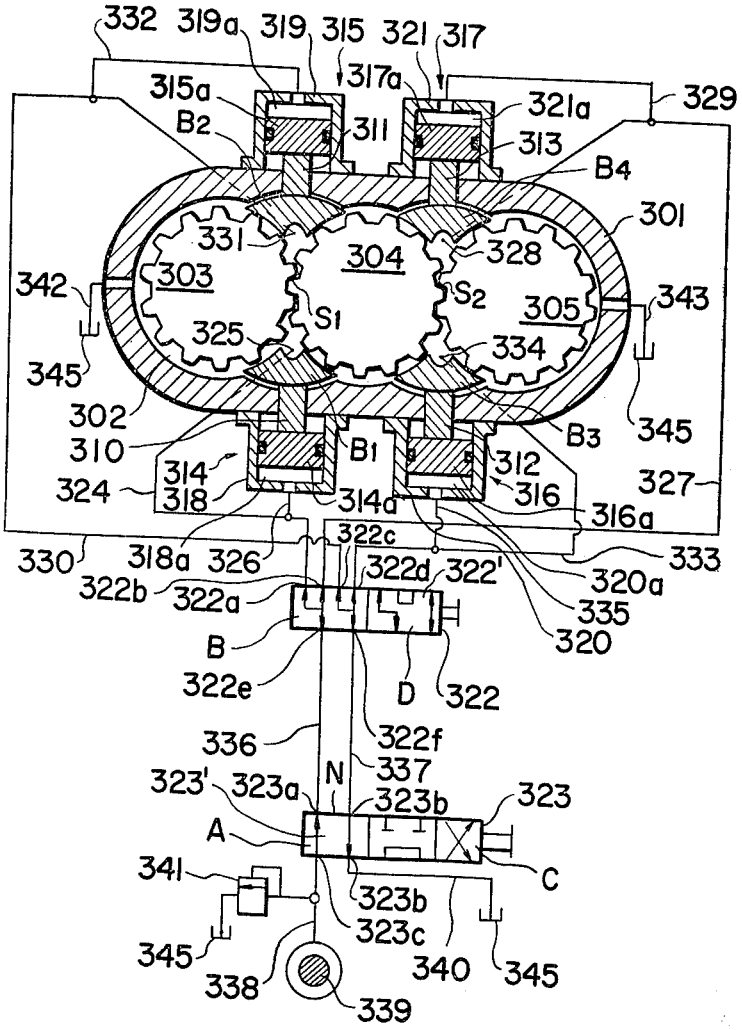
FIGS. 12 and 13 are views similar to that of FIG. 11, showing however the gear pump and motor under various operative conditions whereby the output torque and speed may be varied.
Figure 13:
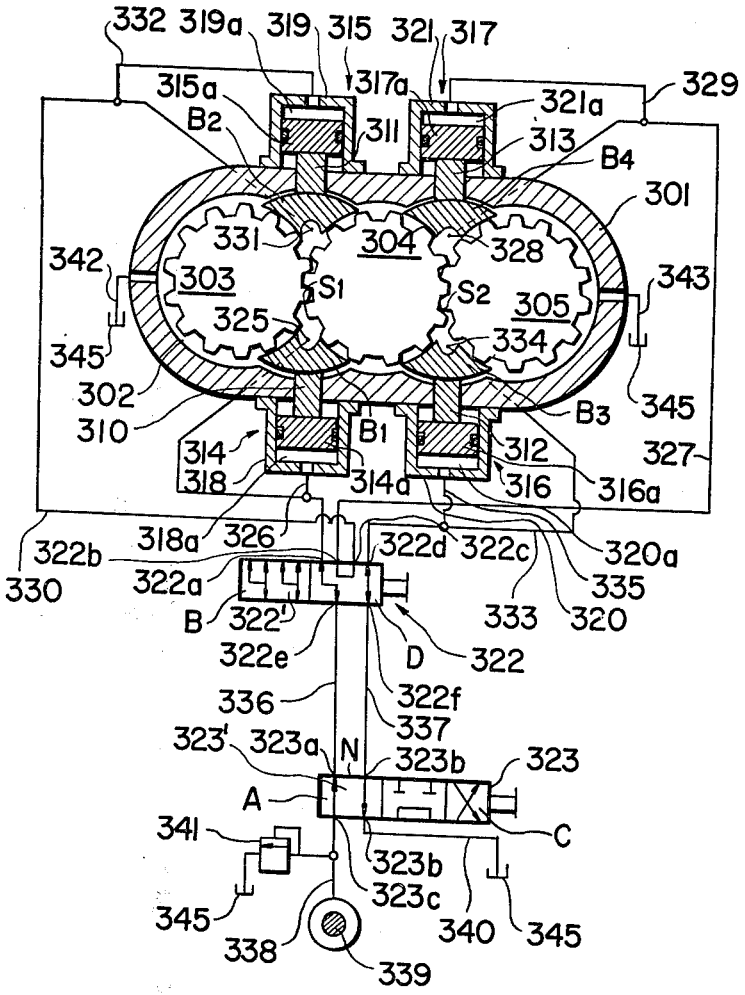

Referring now to FIGS. 11 – 13, still another embodiment of the gear pump and motor constructed according to the present invention is shown as including a substantially ovoid housing 301 which has a gear chamber 302 in which gears 303, 304 and 305 are disposed in such a manner that the axes of the gears are co-planar, gear 303 being intermeshed with the gear 304 which in turn is interengaged with the gear 305. The housing has front and rear covers not shown, as well as bearings, also not shown, for rotatably supporting the respective gears 303, 304 and 305, the output drive shaft for transmitting the drive torque externally of the pump and motor being capable of being connected to either of the gears 303, 304 or 305. Antifrictional wear plates are also interposed between the gears 303, 304 and 305, and seal side plates, also not shown, are of the self-holding type.

The pump and motor also comprises a first pair of seal blocks B1 and B2 disposed upon opposite sides of the engaging area S1 between the gears 303 and 304, and a second pair of seal blocks B3 and B4 similarly disposed upon opposite sides of the engaging area S2 between the gears 304 and 305. Piston rods 310, 311, 312 and 313 are respectively connected at one end thereof to the seal blocks B1, B2, B3 and B4, and project outwardly of the housing 301 so as to be respectively connected at the other end thereof with pistons 314*a*, 315*a*, 316*a* and 317*a* which are respectively slidably disposed within cylinders 318, 319, 320 and 321 which are mounted upon the peripheral surface of housing 301 so as to form cylinder mechanisms, generally indicated by the reference characters 314, 315, 316 and 317.

A manually operable control valve 322 has ports 322*a*, 322*b*, 322*c* and 322*d* disposed along one side thereof and ports 322*e* and 322*f* disposed along the other side thereof, a spool 322' being movable therein, whereby when the spool is located at a first position B, both the ports 322*a* and 322*b* are in communication with the port 322*e* and both the ports 322*c* and 322*d* are in communication with the port 322*f*, whereas when the spool is moved to a second position D, port 322*a* is in communication with the port 322*e* while the port 322*b* is in communication with the port 322*c* and port 322*d* is in communication with the port 322*f* as seen in FIG. 13.

Port 322*a* is also connected through means of a conduit 324 to a port 325 provided within the vicinity of seal block B1 and the engaging area S1 and is further connected through means of a conduit 326, which branches off from conduit 324, to the lower section 318*a* of the cylinder 318, while port 322*b* is similarly connected through means of a conduit 327 to a port 328 provided within the vicinity of seal block B4 and the engaging area S2, and is also connected through means of a conduit 329, which branches off from conduit 327, to the upper section 321*a* of the cylinder 321. Port 322*c* is likewise connected through means of a conduit 330 to a port 331 provided within the vicinity of seal block B2 and the engaging area S1, and is also connected through means of a spur conduit 332, relative to conduit 330, to the upper section 391*a* of the cylinder 319, and port 322*d* is connected through means of a conduit 333 to a port 334 provided within the vicinity of seal block B3 and of the engaging area S2, and is also connected through means of a spur conduit 335, relative to conduit 333, to the lower section 320*a* of the cylinder 320, as seen in FIG. 11.

The pump and motor is also provided with another control valve 323 which is manually operable and which has ports 323*a* and 323*b* at one side thereof, and ports 323*c* and 232*d* at the other side thereof, a spool 323' being movably disposed therein and wherein there is provided a neutral position N at which the ports 323*a* and 323*b* are not connected to any other port while the port 323*c* is in communication with the port 323*d*, a first operable position A wherein the port 323*a* is in communication with the port 323*c* while port 323*b* is in communication with the port 323*d*, and a second position C wherein port 323*a* is in communication with port 323*d* while port 323*b* is in communication with the port 323*c*. Port 323*a* is also connected through means of a conduit 336 with the port 322*e* of the control valve 322, and the port 323*b* is similarly connected through means of a conduit 337 with the port 322*f* of the control valve 322. Port 323*c* of the control valve 323 is connected through means of a conduit 338 to pump 339 at the discharge side thereof and also to a relief valve 341 which in turn leads to a reservoir tank 345, and the port 323*d* is also connected through means of a drain condiut 340 to the fluid reservoir or tank 345. Conduits 342 and 343 which are disposed upon opposite sides of the pump and motor housing 301 also serve as drain conduits which are also in communication with the tank 345.

Within the gear pump and motor thus constructed according to this embodiment, when the spool 322' of the control valve 322 is disposed at the first position B, and the spool 323' of the control valve 323 is disposed at the first position A, as shown in FIG. 12, hydraulic fluid discharged from the pump 339 is fed through means of the conduit 338, port 323*c* of the control valve 323, conduit 336, port 322*e* of the control valve 322, and the ports 322*a* and 322*b* which respectively lead to separate control circuits, the first of which includes conduit 324 and port 325, as well as conduit 326 which leads to the lower section 318*a* of the cylinder 318 for actuating the piston 314*a* so as to in turn bias the seal block B1 through means of the piston rod 310 into the engaging area S1 whereupon a torque is generated between the gears 303 and 304, while the second circuit includes the conduit 327 and the port 328, as well as the conduit 329 which leads to the upper section 321*a* of the cylinder 317 for actuating the piston 317*a* which in turn biases the seal block B4, through means of the piston rod 313, into the engaging area S2 whereupon a torque is generated between the gears 304 and 305. Thus, hydraulic fluid fed to the ports 325 and 328 generate respective torques between the gears 303 and 304, and 304 and 305, and accordingly when the output shaft is mounted upon the gear 304, the output torque is the sum of the torques generated between the gears 303 and 304, and 304 and 305.

The hydraulic fluid exhausted from the port 331 associated with the seal block B2 is fed through means of the conduit 330, and the port 322*c* of the control valve 322 while the hydraulic fluid exhausted from the port 334 associated with the seal block B3 is fed through means of the conduit 333 and the port 322*d* of the control valve 322 whereupon the exhausted hydraulic fluids are mixed within the spool 322' of the control valve 322 and are then fed through the port 322*f*, conduit 337, ports 323*b* and 323*d* of the control valve 323, and drain conduit 340 which is connected to the tank 345. As the hydraulic fluid within the conduits 330 and 333 is of very low pressure, the fluid fed through the conduit 332 to the upper section 319*a* of the cylinder 319 is not able to actuate the piston 315*a* and accordingly the seal block B2 is not biased toward the gears 303 and 304, and similarly, the low pressure fluid fed through the conduit 333 to the lower section 320*a* of the cylinder 320 is not able to a actuate the piston 316*a* and accordingly the seal block B3 is not biased toward the gears 304 and 305.

It is noted that if the spool 323' of the control valve 323 is transferred to the position C whereby the fluid flow is in a direction opposite to that described heretofore, the operation of the gear pump and motor is nevertheless the same. However, when the spool 322' of the control valve 322 is transferred to the position D, as shown in FIG. 13 while the spool 323' of the control valve 323 remains at the position A, the hydraulic fluid discharged from the pump 339 is fed through means of the conduit 338, ports 323*c* and 323*a* of the control valve 323, conduit 336, ports 322*e* and 322*a* of the control valve 322, and conduit 324 to port 325 as well as through conduit 326 to the lower section 318*a* of the cylinder 318 so as to actuate the piston 314*a* and consequently the seal block B1, through means of the piston rod 310, toward the gears 303 and 304 so as to generate a torque between the gears 303 and 304.

The hydraulic fluid exhausted from the port 331 is then fed through means of the conduit 330, ports 322*c* and 322*b* of the control valve 322, conduit 327, and port 328, and is subsequently exhausted from the port 334 via conduit 333, ports 322*d* and 322*f* of the control valve 322, conduit 337, ports 323*b* and 323*d* of the control valve 323, and conduit 340 to the tank 345. In addition, hydraulic fluid is also fed to port 331 from port 328, however, as the hydraulic pressure within the conduits 330 and 327 is quite low, the pistons 315*a*, 316*a* and 317*a* are not able to actuate the seal blocks B2, B3 and B4 sufficiently so as to generate respective torques, and accordingly, torque is not generated between the gears 304 and 305. Within the aforedescribed gear pump and motor, it it noted further that if the spool 323' of the control valve 323 is transferred to the position C, the hydraulic fluid flow is operative in a direction opposite that described heretofore, however the operation of the gear pump and motor remains the same. Thus, assuming that the torque generated by the gears 303 and 304 is represented as To, the torque of the output shaft as T, and the output shaft speed as N, when the spool 322' of the control valve 322 is disposed at the position D, the following relation is obtained:

| Position of Effective Spool of Control Valve 322 | Torque of Output Shaft T | Output Shaft Speed |
|---|---|---|
| B | 2To | N/2 |
| D | To | N |

It should therefore be understood from the foregoing description of this embodiment of the present invention that since the gear pump and motor of this embodiment comprises a housing 301, first, second and third gears 303, 304 and 305, first and second seal blocks B1 and B2 disposed upon opposite sides of the engaging area S1 between the first and second gears 303 and 304, third and fourth seal blocks B3 and B4 disposed upon opposite sides of the engaging area S2 between the second and third gears 304 and 305, a plurality of piston and cylinder mechanisms 314, 315, 316 and 317 mounted upon the housing 301 and operable in conjunction with the seal blocks B1, B2, B3 and B4, respectively, and the first control valve 322, the hydraulic fluid from the pump 339 may be fed to any one or two of the cylinder mechanisms and ports so as to urge the corresponding seal blocks toward the gears in order to appropriately vary the force impressed upon the seal blocks B1, B2, B3 and B4 in response to the output hydraulic pressure whereby the torque of the output shaft and output speed are changed in accordance with the operation of the control valve 322 in order to effectively operate the gear pump and motor.

Figure 14:
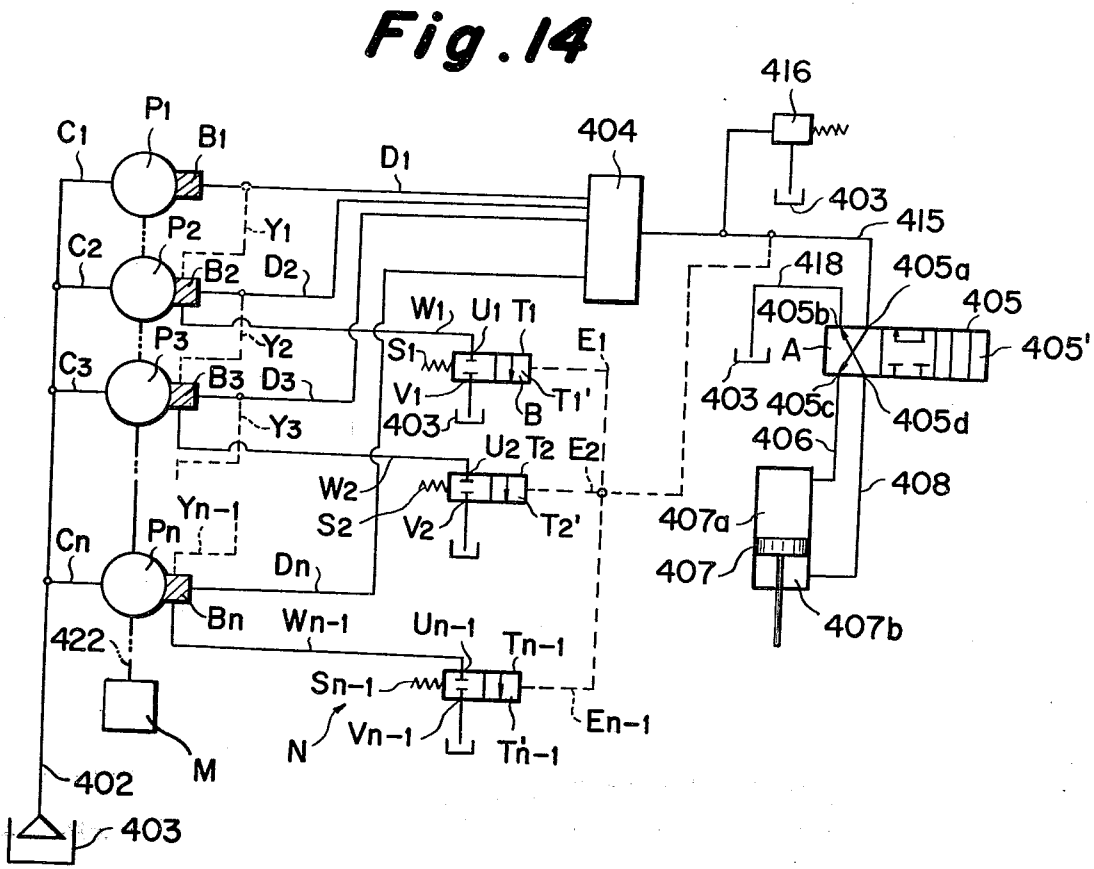
FIG. 14 is a schematic view of a further embodiment of a gear pump and motor constructed according to the present invention and showing its cooperative parts.

Turning now to FIGS. 14 amd 15, wherein still another embodiment of the gear pump and motor of the present invention is shown, the gear pump and motor may comprise a plurality of pumps P1, P2, . . . P*n* each having respectively associated therewith seal members B1, B2, B*n* which include a seal block and a seal side plate disposed adjacent to the seal block, not shown, and which is in contact with the gears of the gear pump and motor. The pumps P1, P2, . . . P*n* are all driven by means of a prime mover M through means of a drive shaft 422. Intake ports of the respective pumps P1, P2, . . . P*n* are connected through means of respective conduits C1, C2, . . . C*n* to a main conduit 402 which is connected to a fluid reservoir or tank 403, and the exhaust ports of the pumps P1, P2, . . . P*n* are respectively connected through means of conduits D1, D2, . . . D*n* to a manifold valve 404 which is connected through means of a conduit 415 to both a control valve 405 and a relief valve 416.

Manually operable control valve 405 has ports 405*a* and 405*b* disposed along one side thereof and ports 405*c* and 405*d* disposed along the other side thereof, and a spool 405' is movably disposed therewithin between a first position A at which port 405*a* is in communication with port 405*c* and port 405*b* is in communication with port 405*d*, a second position N at which port 405*a* is in communication with the port 405*b* and the ports 405*c* and 405*d* are not in communication with any other port, and a third position whereby the ports are in communication in an order reverse to that associated with the first position A. In addition, port 405*a* is in communication with the manifold valve 416 through means of conduit 415, port 405*b* is in communication through means of a drain conduit 418 with a fluid reservoir 403, port 405*c* is in communication through means of a conduit 406 with the upper section 407*a* of a actuator 407, such as for example, a cylinder device, as shown in FIG. 14, and port 405*d* is connected through means of a conduit 408 to the lower section 407*b* of the actuator 407.

There is also provided a plurality of control valves T1, T2, . . . T*n*-1, each of which has ports U1, U2, . . . U*n*-1 and V1, V2, . . . V*n*-1 and spools T1', T2', . . . T*n*-1' respectively, the spools being movable between a first position wherein the ports U1, U2, . . . U*n*-1 and V1, V2, . . . V*n*-1 are not in communication with any other port and a second position at which ports U1, U2, . . . U*n*-1 are in communication with ports V1, V2, . . . V*n*-1. Each of the control valves T1, T2, . . . T*n*-1 has springs S1, S2, . . . S*n*-1 respectively connected at one end thereof so as to bias the spools T1', T2', . . . T*n*-1' against the hydraulic pressure supplied thereto through means of pilot conduits E1, E2, . . . E*n*-1 which respectively connects the other ends of the control valves T1, T2, . . . T*n*-1 with the ports 405*a* of the control valve 405 and accordingly the conduit 415 which is connected to the manifold valve 404. The ports U1, U2, . . . U*n*-1 are respectively connected through means of conduits W1, W2, . . . W*n*-1 to the seal members B2, B3, . . . or B*n*, while the ports V1, V2, . . . V*n*-1 are connected to the fluid. reservoir 403 and pilot conduits Y1, Y2, . . . Y*n*-1 interconnect the conduits D1, D2, . . . D*n*-1 with the seal members B2, B3, . . . B*n* for control purposes. Thus, a control mechanism, generally indicated by the reference character N is formed by means of the conduits D1, D2, . . . D*n*, conduits W1, W2, . . . W*n*-1 control valves T1, T2, . . . T *n*-1 and pilot conduits E1, E2, . . . E*n*-1.

Within the gear pump and motor thus constructed according to this embodiment, when the spool 405' of the control valve 405 is shifted to the position A, and the pump and motor P1 operates hydraulic fluid is drawn from the fluid reservoir 403 and is conducted through the main conduit 402 and conduit C1 and is accordingly discharged through the conduit D1, manifold valve 404, conduit 415, control valve 405, and conduit 406 so as to enter the upper section 407*a* of the actuator 407.

In this state, however, if the hydraulic fluid pressure thus supplied to the actuator 407 is not sufficient so as to actuate the same at the desired speed, hydraulic fluid is then fed from the conduit D1 through pilot conduit Y1 to the seal member B2 of the pump and motor P2 so as to move the seal member B2 toward the gears within the pump and motor P2 whereupon pump and motor P2 will commence operation and accordingly hydraulic fluid thus discharged from the pump and motor P2 will be fed through the conduit D2, manifold valve 404, conduit 415, control valve 405, and conduit 406 into the upper section 407*a* of the actuator 407.

If the hydraulic fluid pressure thus supplied to the actuator 407 is still not sufficient so as to actuate the actuator 407, hydraulic fluid will then be fed from the conduit D2 through pilot conduit Y2 to the seal memer B3 of the pump and motor P3 so as to move the seal member B3 toward the gears within the pump and motor P3 whereupon pump and motor P3 commences operation to pump additional hydraulic fluid which is discharged therefrom and is fed through the conduit D3, manifold valve 404, conduit 415, control valve 405, and conduit 406 into the upper section 407*a* of the actuator 407. The other pumps and motors P4, . . . P*n* may of course be subsequently operated in order to increase the discharge pressure of the hydraulic fluid in order to attain the desired spped of the actuator 407.

Figure 15:
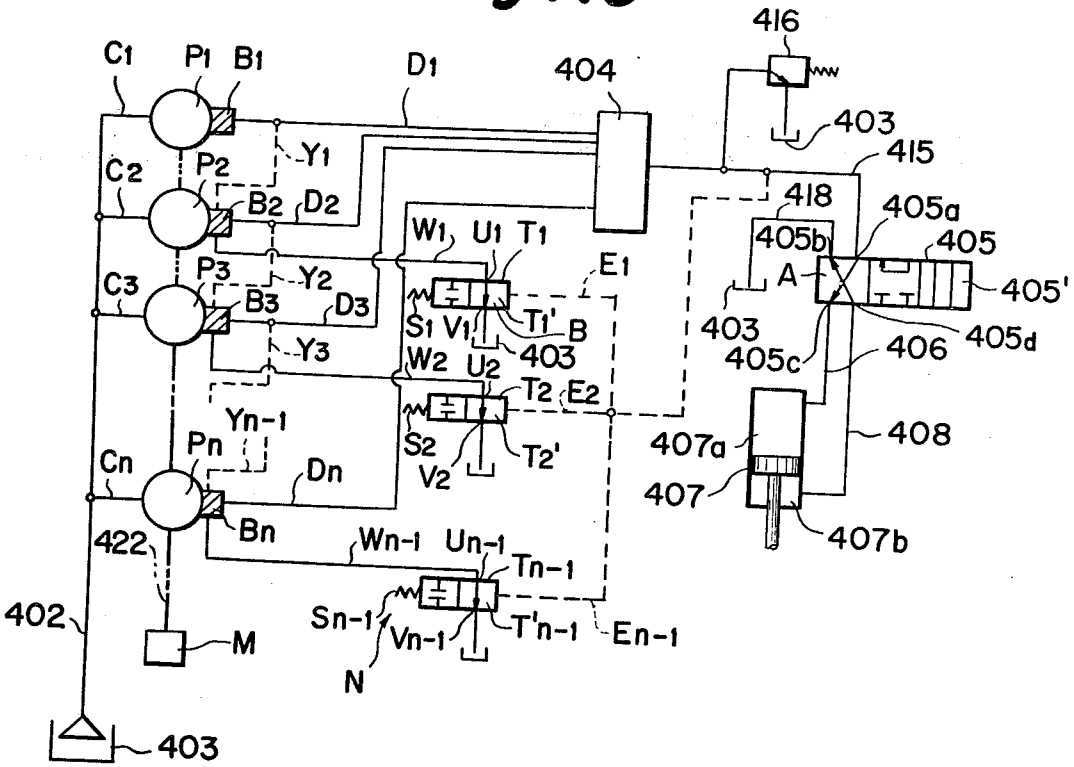
FIG. 15 is a view similar to that of FIG. 14, showing however the gear pump and motor under high speed operative conditions.

It should be noted that if the springs S1, S2, . . . S*n*-1 respectively associated with the control valves T1, T2, . . . T*n*-1 are such that the tensional forces within the springs is progressively smaller, such relation being designated as S1>S2>S3 . . . S*n*-2>S*n*-1, when the hydraulic pressure thus supplied to the actuator 407 becomes greater than the inherent tensional force within spring S*n*-1 associated with the control valve T*n*-1 after all the other pumps and motors P1, P2. . . . P*m* having commenced operating, then the hydraulic pressure applied to the spool T*n*-1' of the control valve T*n*-1 will shift the spool T*n*-1' of the control valve T*n*-1 to the alternate position B as shown In FIG. 15, and accordingly the port U*n*-1 will now be in communication with the port V*n*-1 with the result that the pilot conduit W*n*-1 which is connected to the seal member B*n* of the pump and motor P*n* is able to be drained through the control valve T*n*-1 to the fluid reservoir 403, and thus the seal member B*n* of the pump and motor P*n* is able to be released from the biased position relative to the gears within the mump and motor P*n* resulting in termination of the pumping action of the pump and motor P*n* and consequent reduction of the supply of hydraulic fluid to the actuator 407.

Similarly, when the hydraulic pressure of the fluid supplied to the actuator 407 subsequently becomes greater than the inherent tensional forces of the springs S*n*-2, S*n*3, . . . S1 respectively associated with the control valves T*n*-2, T*n*-3, . . . T1, the spools of the control valves T*n*-2, T*n*-3, . . . T1 will be subsequently shifted to the alternate position B, as shown in FIG. 15, whereupon the pressures tending to urge the seal members B*n*-1, B*n*-2, . . . B2 of the pumps and motors P*n*-1, P*n*-2, . . . P2 toward the gears of the pumps and motors will abate resulting in the termination of the respective pumping operations of the pumps and motors P*n*-1, P*n*-2, . . . P2 so as to further reduce the supply of hydraulic fluid to the actuator in response to the load impressed upon the actuator 407.

In considering the pumps and motors P1, P2, . . . P*n* as hydraulic motors, the hydraulic operation is diametrically opposite that described heretofore, such that the actuator 407 becomes a pump and the control valves T1, T2, . . . T*n* are automatically operated in accordance with the variation in the discharge pressure of the actuator pump and thus the pumps and motors P1, P2, . . . P*n* are operated so as to generate the various desired torques therefrom.

It should also be understood from the foregoing description of this embodiment that since the gear pump and motor of this embodiment of the present invention comprises a plurality of pumps P1, P2, . . . P*n*, each having at least three gears, respective seal members B1, B2, . . . B*n* disposed within the vicinity of the engaging areas of the gears and wherein the pumps are simultaneously driven by means of a prime mover, and a plurality of control valves means T1, T2, . . . T*n*-1 for controlling the fluid pressure supplied to the seal members so as to move the same relative to the gears of the pumps, the pumps P1, P2 . . . P*n* may be effectively and efficiently operated as described in detail heretofore.

Figure 16:
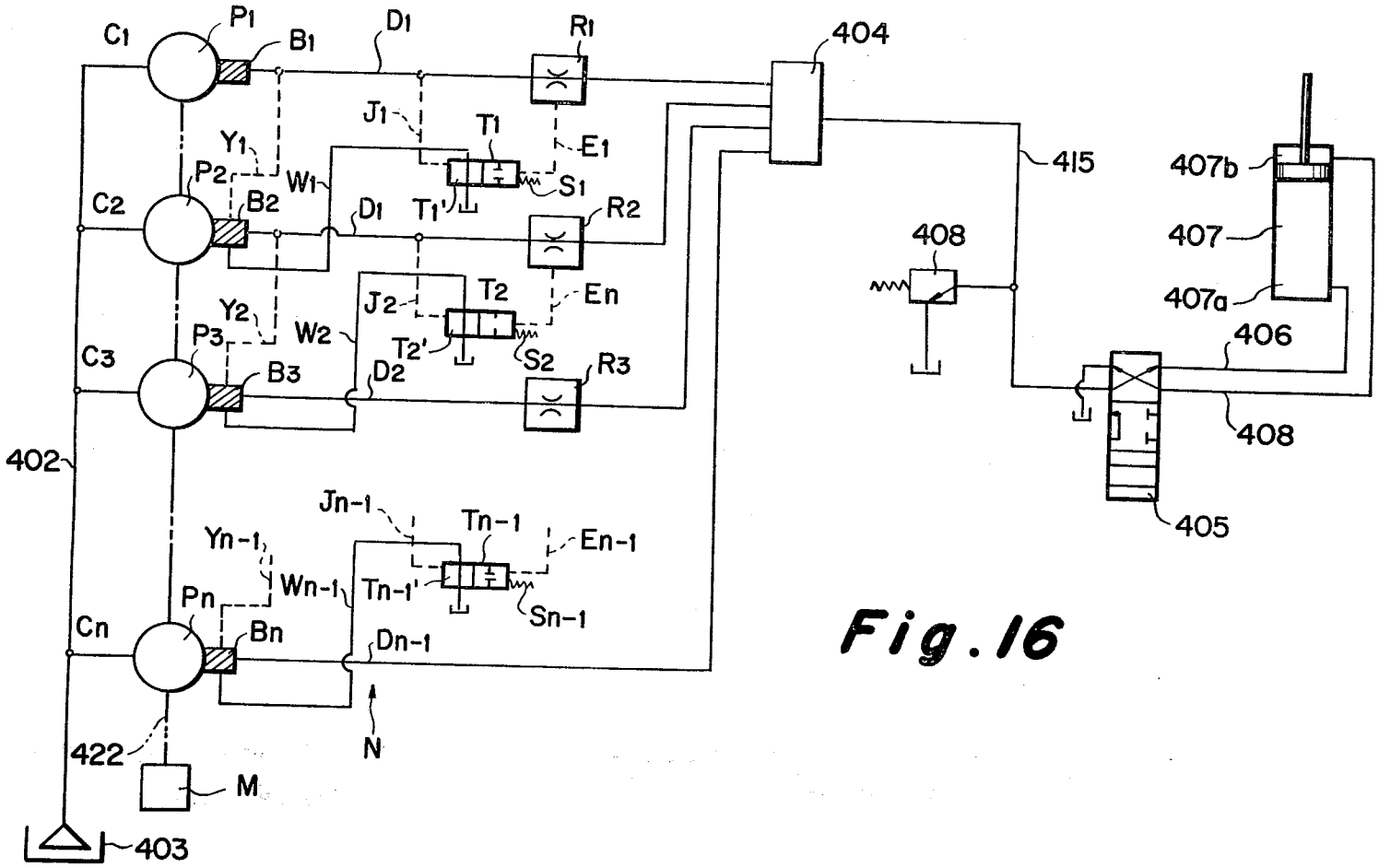
FIG. 16 is a view similar to that of FIG. 14 showing however a still further embodiment of a gear pump and motor constructed according to the present invention and showing its cooperative parts, the gear pump and motor being under high speed operative conditions.
Figure 17:
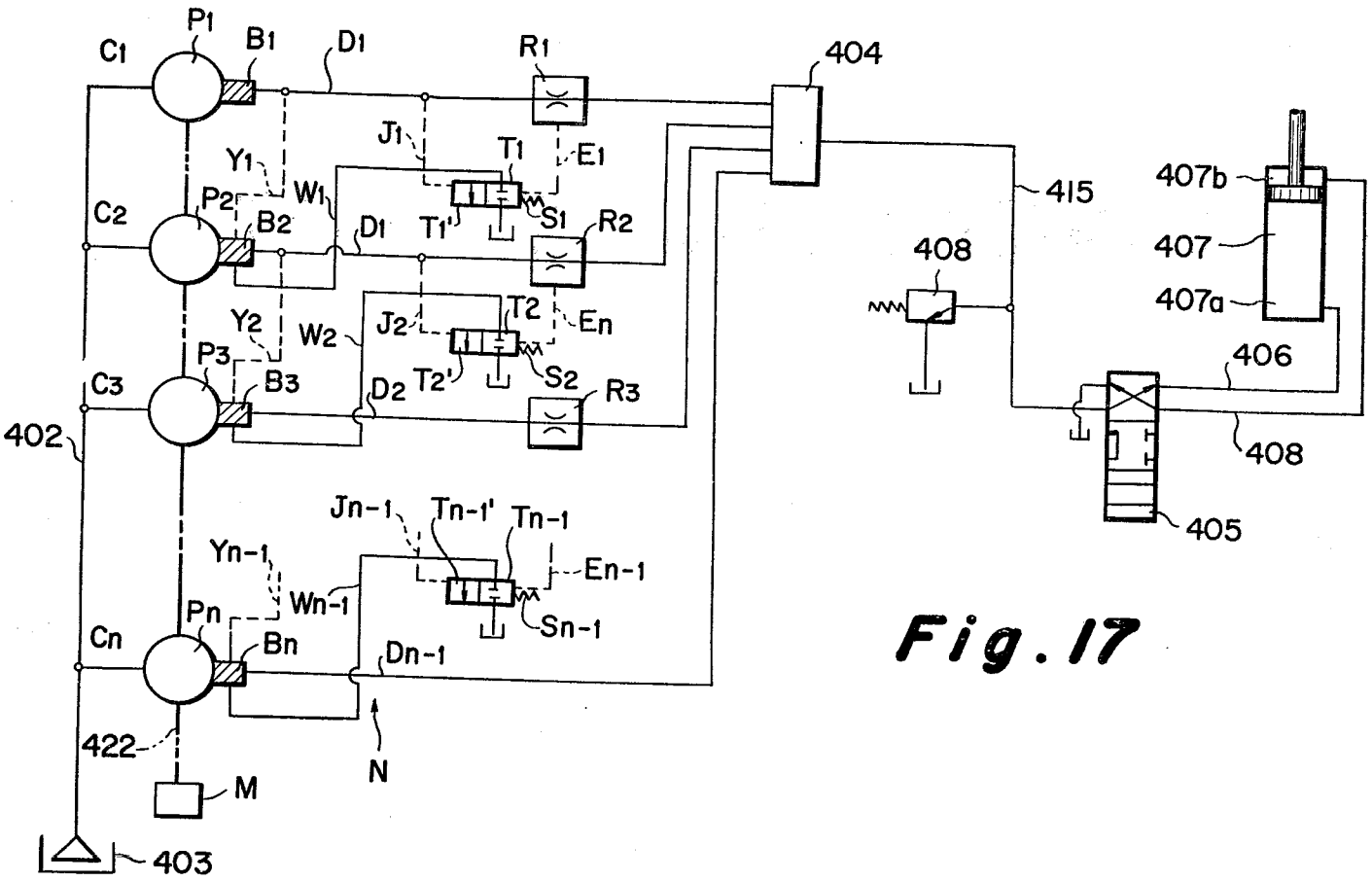
FIG. 17 is a view similar to that of FIG. 16 showing however the gear pump and motor under low speed operative conditions.

With particular reference now to FIGS. 16 and 17, there is shown still another embodiment of the gear pump and motor constructed according to the present invention which includes a plurality of pumps P1, P2, . . . P*n* having associated therewith a plurality of throttle members R1, R2, . . . R*n* respectively disposed within conduits D1, D2, . . . D*n* which are respectively connected at one end to the discharge means of the pumps P1, P2, . . . P*n* and at the other end thereof to the manifold valve 404, the structure of this embodiment being similar to that disclosed within FIGS. 14 and 15.

Control valves T1, T2, . . . T*n*-1 have valve spools T1', T2', . . . T*n*-1 slidably disposed therein, and springs S1, S2, . . . S*n*-1 disposed at one end thereof for biasing the spools T1', T2', . . . T*n*-1 against the hydraulic pressure supplied through means of pilot conduits J1, J2, . . . J*n*-2 which are connected to the other ends of the spool T1', T2', . . . T*n*-1 respectively. Conduits E1, E2, . . . E*n*-1 are additionally provided so as to interconnect the control valves T1, T2, . . . T*n*-1 with the minimum diameter portions of the throttle members R1, R2, . . . R*n*-1 so as to control the movement of the seal members B1, B2 . . . B*n*-1 toward the gears within the pumps P2, P3, . . . P*n* as a function of the hydraulic pressure difference between the inlet side and the throttle side of the pumps through means of pilot conduits W1, W2, . . . W*n* -1 which are connected between the control valves T1, T2, . . . T*n*-1 and the seal members B2, B3, . . . B*n*-1.

Within the gear pump and motor thus constructed, when the pump and motor P1 is driven, hydraulic fluid is fed from the fluid reservoir 403 through the main conduit 402 and the conduit C1, through the conduit D1, manifold D1, manifold valve 404, conduit 415, control valve 405, and conduit 406 to the actuator 407.

If the hydraulic fluid thus supplied to the actuator 407 is insufficient however to actuate the actuator 407 with only the pump and motor P1 being operated, the pressure difference between the fluid flowing through the minimum diameter portion of the throttle member R1 and the fluid flowing through the inlet side of the pump and motor P1 is small, the spool T1′ of the control valve T1 is moved by means of the spring S1 so that the ports of the control valve T1 are shut off from each other, as shown in FIG. 17, whereby the hydraulic fluid associated with the seal member B2 of the pump and motor P2 which normally communicates through means of the conduit W1 and control valve T1 with the fluid reservoir 403 is not able to be drained therefrom, and consequently, the hydraulic fluid from the conduit D1 is fed through means of the pilot conduit Y1 to the seal member B2 of the pump and motor P2 so as to move the seal member B2 toward the gears within the pump and motor P2 whereupon the pump and motor P2 will begin to pump hydraulic fluid and accordingly discharge the hydraulic fluid through means of the conduit D2, manifold valve 404, conduit 415, control valve 405 and conduit 406 to the actuator 407. The pumps and motors P3, P4, . . . P*n* may of course be subsequently operated so as to discharge additional hydraulic fluid to the actuator 407.

When, however, excessive hydraulic fluid is supplied to the actuator whereby the hydraulic pressure fed to the actuator 407 is substantially increased with the result that the pressure difference between the fluid flowing through the inlet side of the pump and motor P*n* and the minimum diameter portion of the throttle R*n*-1 is greater than the inherent tensional force of the spring S*n*-1 of the control valve T*n*-1, the spool T*n*-1′ of the control valve T*n*-1 is shifted to the alternate position as shown in FIG. 16 so that the ports of the control valve T*n*-1 are again in communication with each other with the result that the hydraulic fluid for controlling the seal member B*n* of the pump and motor P*n* is drained through means of the pilot conduit W*n*-1 and the control valve T*n*-1 to the fluid reservoir 403 whereby the pressure tending to bias the seal member B*n* of the pump and motor P*n* toward the gears within the pump and motor P*n* is released resulting in termination of the pumping action of the pump and motor P*n*. Thus, as the pressure difference becomes successively greater than the inherent tensional forces of the springs S*n*-2, S*n*-3, . . . and S1, the operation of the pumps and motors P*n*-1, P*n*-2, . . . and P2 is subsequently terminated, assuming of course that the inherent tension forces within the springs of the control valves are progressively smaller such relation being designated as S1> S2> S3 . . . S*n*-1 with respect to the springs arranged as shown in FIGS. 16 and 17.

In considering the pumps and motors P1, P2, . . . P*n* as hydraulic motors, the hydraulic operation is of course diametrically opposite to that described heretofore such that the actuator 407 becomes a pump, and the control valves T1, T2, . . . and T*n* are automatically operated in accordance with the variation in the discharge pressure of the actuator as a pump and thus the pumps and motors P1, P2, . . . and P*n* are operated so as to generate the various desired torques therefrom.

Figure 18:
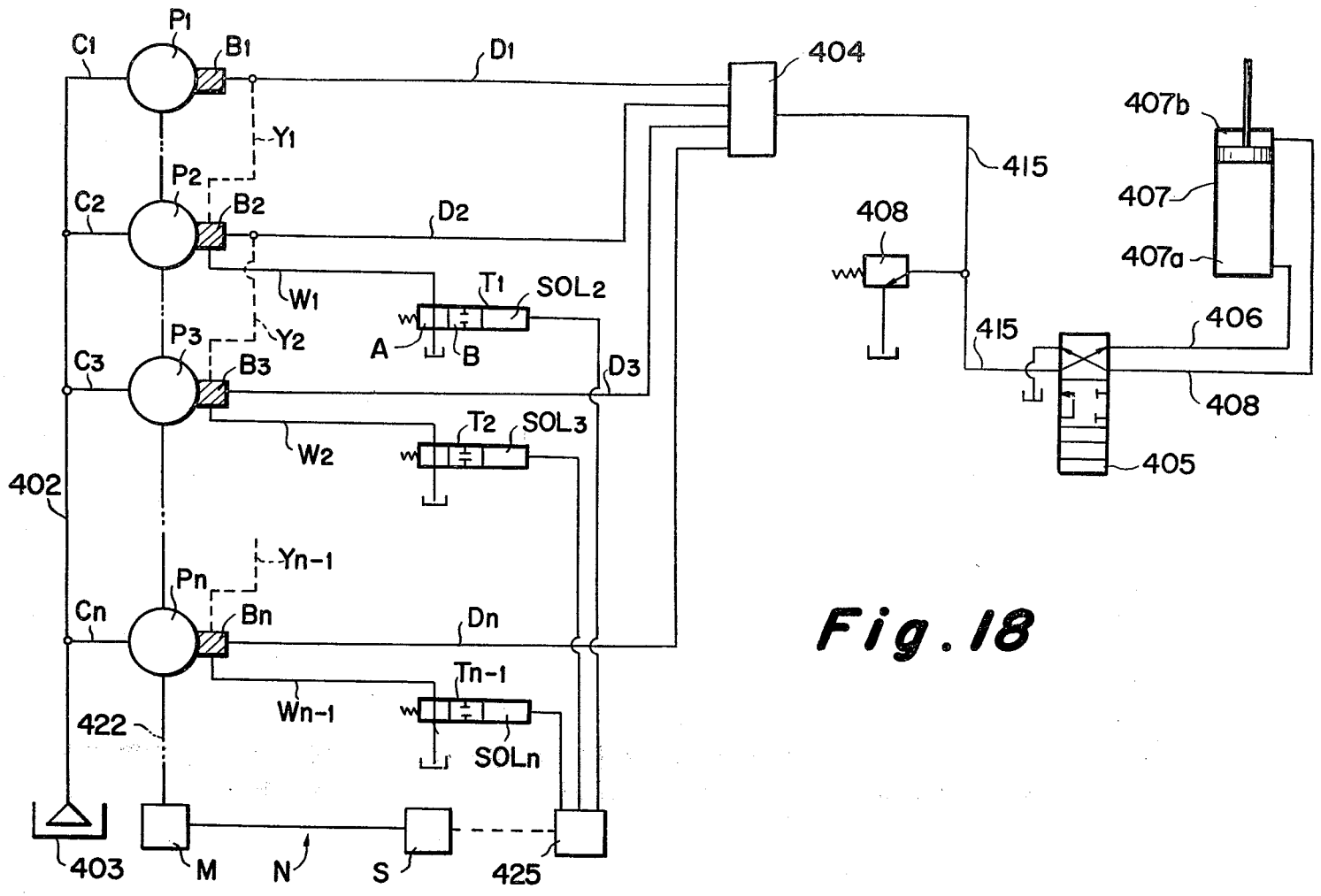
FIG. 18 is a view similar to that of FIG. 14 showing however a still further embodiment of a gear pump and motor constructed according to the present invention and showing its cooperative parts, the gear pump and motor being under high speed operative conditions.
Figure 19:
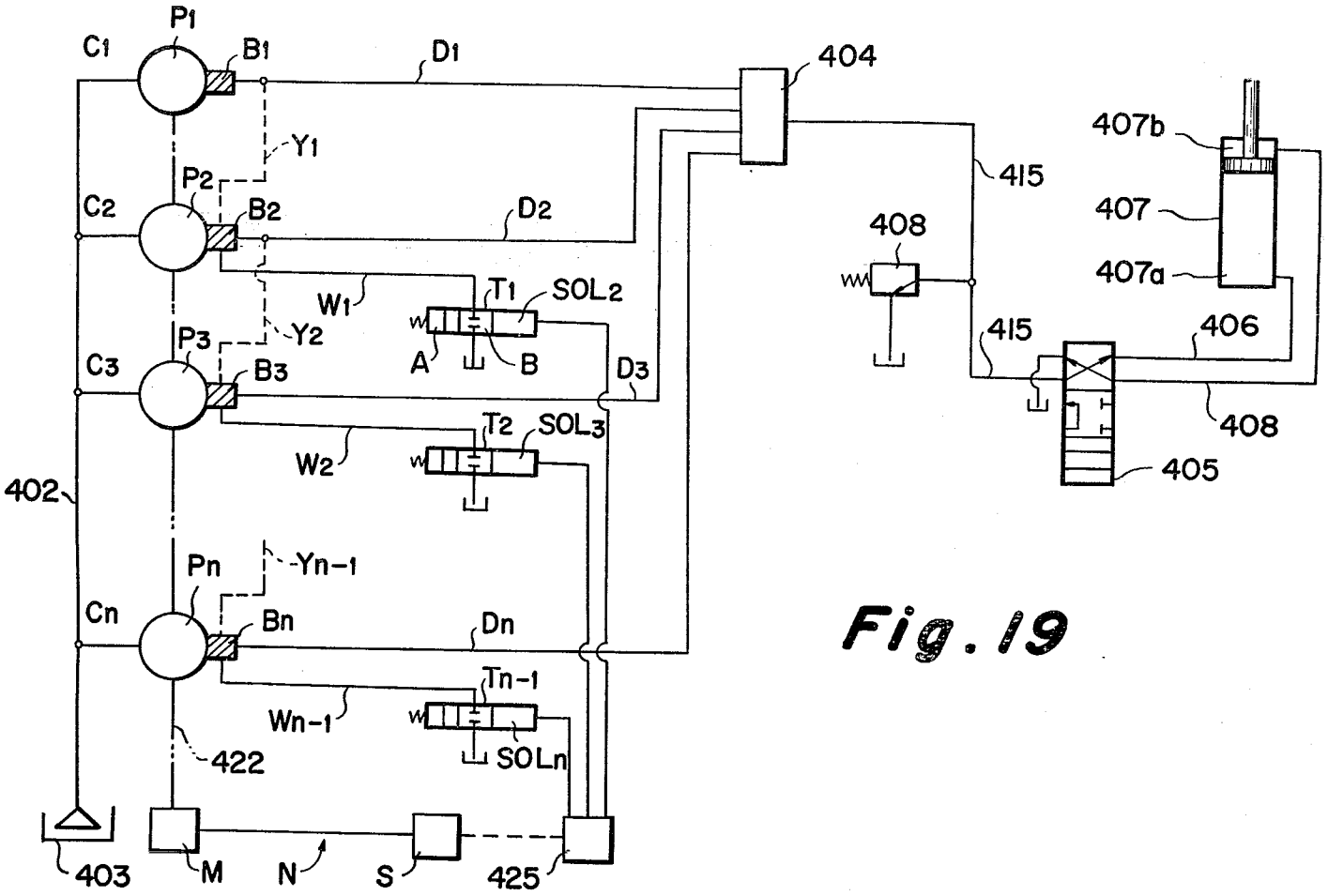
FIG. 19 is a view similar to that of FIG. 18 showing however the gear pump and motor under low speed operative conditions.

With reference now being made to FIGS. 18 and 19, which show still another embodiment of the gear pump and motor constructed according to the present invention and which is somewhat similar to that embodiment shown in FIGS. 14 and 15, the gear pump and motor of this embodiment includes a control mechanism, generally indicated by the reference character N which has a revolution detector S for detecting the rotational speed of the prime mover M associated with the pumps P1, P2, . . . P*n* and a control circuit 425 electrically connected to the revolution detector S as well as to a plurality of solenoid control valves T1, T2, . . . T*n*-1 which are respectively hydraulically connected to the seal members B2, B3, . . . B*n* of the pumps and motors P2, P3, . . . P*n* through means of pilot conduits W1, W2, . . . W*n*-1 respectively. Pilot conduits Y1, Y2, . . . Y*n*-1 also hydraulically interconnect the conduits D1, D2, . . . D*n*-1 and seal members B2, B3, . . . B*n* of the pumps and motors P2, P3, . . . P*n*, respectively, as in the previously described embodiments, and it is noted that in operation, the control circuit 425 operates so as to deenergize the solenoids SOL2, SOL3, . . . SOL*n* of the solenoid control valves T1, T2, . . . T*n*-1 when the rotational speed of the prime mover M is high in order to shift the spools of the control valves T1, T2, . . . T*n*-1 to the position A at which the ports of the control valves T1, T2 . . . T*n*-1 are in communication with each other, and to energize the solenoids SOL2, SL3, . . . SOL*n* when the rotational speed of the prime mover M is low.

Within the gear pump and motor thus constructed, when the pump and motor P1 is driven, hydraulic fluid is fed from the fluid reservoir 403 through the main conduit 402, conduit C1, conduit D1, manifold valve 404, conduit 415, control valve 405, and conduit 406 to the actuator 407.

If however the hydraulic fluid thus supplied to the actuator 407 is insufficient to actuate the actuator 407 with only the pump and motor P1 being operated, hydraulic fluid is fed from the conduit D1 through means of pilot conduit Y1 to the seal member B2 of the pump and motor P2 so as to move the seal member B2 toward the gears within the pump and motor P2 so as to actuate pump and motor P2 and accordingly hydraulic fluid discharged from the pump and motor P2 is fed through means of the conduit D2, manifold valve 404, conduit 415, control valve 405, and conduit 406 into the lower section 407*a* of the actuator 407.

At this time, since the rotational speed of the prime mover M is low, such speed is detected by means of the revolution detector S whereby the control circuit 425 energizes the solenoid control valve T1 so as to energize the solenoid SOL2 in order to shift the spool of the control valve T1 to the position B and thus hydraulic fluid within the pilot conduit W1 is not able to be drained to fluid reservoir 403 whereupon seal member B2 is then moved toward the gears within the pump and motor P2 with the result that the pump and motor P2 commences to pump hydraulic fluid. The other pumps and motors P3, P4, . . . P*n* are of course similarly subsequently operated in order to provide additional hydraulic fluid to actuator 407 whereupon the speed of the actuator 407 is increased by the factor *n*.

When the rotational speed of the prime mover M becomes high, the control valve 425 deenergizes the solenoids SOL*n*, SOL*n*-1, . . . SOL2 of the solenoid control valves T*n*-1, T*n*-2, . . . T1 so as to shift the spools of the control valves T*n*-1, T*n*-2, . . . T1 to the position A whereby the ports of the control valves TN-1, TN-2, . . . T1 are in communication with each other with the result that hydraulic fluid within the seal members B*n*, B*n*-1, . . . B2 is able to be drained through the pilot conduits WN-1, W*n*-2, . . . W1 and the solenoid control valves T*n*-1, T*n*-2, . . . T1 to the fluid reservoir 403. As a result, the pressure tending to move the seal members B*n*, B*n*-1, . . . B2, toward the gears within the pumps and motors P*n*, P*n*-1, . . . P2 is reduced whereupon the operation of the pumps and motors P*n*, P*n*-1, . . . P2 is terminated.

It should be understood from the foregoing description of the latter two embodiments that since the gear pump and motor of one of such embodiments of the present invention comprises a plurality of pumps P1, P2, . . . P*n* each having at least three gears, seal members B1, B2, . . . B*n* respectively disposed within the vicinity of the engaging areas between the gears, throttle members R1, R2, . . . R*n*, respectively disposed within the outlet circuit of the pumps and motors P1, P2, . . . P*n*-1, a plurality of control valve means T1, T2, . . . T*n*-1 and hydraulic conduits E1, E2, . . . E*n*-1 interconnecting the minimum diameter portions of the throttle members R1, R2, . . . R*n*-1 with the control valves T1, T2, . . . T*n*-1 so as to control the movement of seal members B1, B2, . . . B*n*-1 toward the gears within the pumps P1, P2, . . . P*n* by means of the hydraulic pressure difference between the fluid flowing at the inlet side of the pumps and the fluid flowing at the minimum diameter portions of the throttle members, and the gear pump and motor of the other embodiment of the present invention comprises a prime mover, a plurality of pumps P1, P2, . . . P*n*, each having at least three gears, seal members B1, B2, . . . B*n* respectively disposed within the vicinity of the engaging areas between the gears, revolution detector means for detecting the rotational speed of the prime mover of the pumps P1, P2, . . . P*n*, control circuit means electrically connected to the revolution detector means, and a plurality of solenoid control valves T1, T2, . . . T*n*-1 each of which is electrically connected to the control circuit means and hydraulically connected to the seal members B2, B3, . . . B*n* of the pumps and motors P1, P2, . . . P*n*, the circuit means serving to respectively deenergize the solenoids SOL2, SOL3, . . . SOL*n* of the solenoid control valves T1, T2, . . . T*n*-1 when the rotational speed of the prime mover is high and for energizing the solenoids SOL2, SOL3, . . . SOL*n* when the rotational speed of the prime mover M is low so as to control the movement of the seal members B2, B3, . . . B*n* of the pumps and motors P2, P3, . . . P*n* toward or away from the gears of the pumps and motors P2, P3, . . . P*n*, whereby the seal members of the pump and motors P1, P2, . . . P*n* may thus be controlled by means of the discharge volume and pressure, the speed of the pumps and motors, or an external force, the pumping action of the gears within the pumps may be reduced by reducing the pressure acting upon the seal members and permit the same to attain idling operation in order to prevent a substantial temperature rise within the hydraulic fluid and reduce the volume and pressure discharge so as to efficiently consume the power of the prime mover.

It should also be understood that since all of the pumps and motors of the gear pump and motor of this invention may be idled during no load, low speed operation without the necessity of having any hydraulic pressure transmitted to the load by reducing the pressure impressed upon the seal members of the pumps and motors, and yet the necessary number of pumps and motors may be selectively operated by selectively actuating the seal members of the pump and motors in response to the load requirements, the decrease in the volume efficiency or wear of the pumps and motors due to the long usage may be sufficiently compensated for and also the gear pump and motor of this invention may be used for various low speed operations, and various attachments may be sufficiently adopted for rated operation with compact structures.

From the foregoing description, it will also become apparent to those skilled in the art that since the seal members of the pumps and motors of the gear pump and motor of this invention may be controlled regardless of the hydraulic discharge pressure and supply pressure by means of the control mechanism N, the degree of sealing of the seal members may also be selected to an optimum value. More particularly, referring to FIG. 2, the gaps between the ends of the teeth and the seal members or blocks, between the side surfaces of the gears and the seal side plates, and between the seal members or blocks and the seal side plates are chosen, as much as possible, within the range such that the volume efficiency is not reduced during high speed operation to the value $\delta$ 1 illustrated in FIG. 2. Such a hydraulic phenomenon is effectively utilized by means of the gears, and the gaps thereof are narrowed as small as possible during low speed operation of the pump and motor so as to improve the volume efficiency of the pump and motor and therefore the wear of the seal members of the pumps and motors, and in addition, seizure of the seal members with respect to the rotary components during high speed operation may be prevented.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A gear pump and motor comprising:

a prime mover;

a housing;

a drive gear driven by said prime mover and at least two driven gears interengaged with said drive gear rotatably mounted within said housing;

first pump means including said drive gear and one of said driven gears;

a first seal block disposed within the vicinity of the engaging area between said drive gear and one of said driven gears;

side balance chambers formed upon the outer surface of said first seal block which are in fluidic communication with the area between the teeth of said drive gear and said one of said driven gears and with each other;

a central balance chamber also formed upon the outer surface of said first seal block which is in fluidic communication with an exhaust hole formed within said first seal block which in turn is in fluidic communication with an exhaust port formed within said housing, said exhaust port having a throttle formed therein;

second pump means including said drive gear and said other one of said driven gears;

a second seal block disposed within the vicinity of the engaging area between said drive gear and said other one of said driven gears;

a pair of balance chambers formed upon the outer surface of said second seal block;

pistons slidably disposed within said balance chambers the latter of which are in fluidic communication with the areas formed between the teeth of said drive gear and said other one of said driven gears and with each other;

a guide tube slidably and sealingly disposed within an exhaust hole formed within said second seal block, the front end of said guide tube being slidably disposed within another exhaust port formed within said housing;

an oil chamber provided within said housing within the vicinity of said another exhaust port;

piston means slidably disposed within said oil chamber for moving said second seal block toward said drive gear and said other one of said driven gears;

control valve means provided within said housing;

a valve spool slidably disposed within said housing and having first, second and third annular grooves formed thereon in such a manner that said first and second annular grooves are in communication with each other and said third annular groove is in communication with an oil chamber formed at the rear end of said valve spool, said oil chamber being in communication with said throttle of said said first pump means and said valve spool is in communication with the area surrounding the gear teeth of said other one of said driven gears;

another oil chamber formed at the front end of said valve means which is in fluidic communication with the inlet side of said exhaust port of said first pump means;

spring means interposed between said valve spool and the rear end of said control valve means for urging said valve spool toward said another oil chamber so as to terminate the communication between said valve spool and said area surrounding said teeth of said other one of said driven gears and;

a passage formed within said housing for connecting said valve spool with said oil chamber of said second pump means for releasing the hydraulic fluid within said oil chamber into said area surrounding said teeth of said other one of said driven gears when said drive gear is driven at high speed.

2. A gear pump and motor comprising:

a pump;

a housing fluidically connected with said pump;

at least one drive gear and two driven gears intermeshed with one another and rotatably mounted within said housing;

first motor means including said drive gear and one of said driven gears;

a first seal block disposed within the vicinity of the engaging area between said drive gear and one of said driven gears;

side balance chambers formed upon the outer surface of said first seal block which are in fluidic communication with the area between the teeth of said drive gear and said one of said driven gears and with each other;

a central balance chamber also formed upon the outer surface of said first seal block which is in communication with an exhaust hole formed within said first seal block which in turn is in communication with an exhaust port formed within said housing, said exhaust port having a throttle formed therein;

second motor means including said drive gear and said other one of said driven gears;

a second seal block disposed within the vicinity of the engaging area between said drive gear and the other one of said driven gears;

a pair of balance chambers formed upon the outer surface of said second seal block;

pistons slidably disposed within said balance chambers the latter of which are in fluidic communication with the areas formed between the teeth of said drive gear and said other one of said driven gears and with each other;

a guide tube slidably and sealingly disposed within an exhaust hole formed within said second seal block, the front end of said guide tube being slidably disposed within another exhaust port formed within said housing;

an oil chamber provided within said housing within the vicinity of said another exhaust port;

piston means slidably disposed within said oil chamber for moving said second seal block toward said drive gear and said other one of said driven gears;

control valve means provided within said housing;

a valve spool slidably disposed within said housing and having first, second and third annular grooves formed thereon in such a manner that said first and second annular grooves are in communication with each other and said third annular groove is in communication with an oil chamber formed at the rear end of said valve spool, said oil chamber being in communication with said throttle of said first motor means and said valve spool is in communication with the area surrounding the gear teeth of said other one of said driven gears;

another oil chamber formed at the front end of said valve means which is in communication with the inlet side of said exhaust port of said first motor means;

spring means interposed between said valve spool and the rear end of said control valve means for urging said valve spool toward said another oil chamber so as to terminate the communication between said valve spool and said area surrounding said teeth of said other one of said driven gears, and;

a passage formed within said housing for connecting said valve spool with said oil chamber of said second motor means for releasing the hydraulic fluid within said oil chamber into said area surrounding said teeth of said other one of said driven gears when said drive gear is driven at high speed.

* * * * *